US011639631B2

(12) United States Patent
Huang et al.

(10) Patent No.: US 11,639,631 B2
(45) Date of Patent: May 2, 2023

(54) WINDOW SHADE AND ACTUATING SYSTEM THEREOF

(71) Applicant: Teh Yor Co., Ltd., New Taipei (TW)

(72) Inventors: Chung-Chen Huang, New Taipei (TW); Chih Hung Hsieh, New Taipei (TW)

(73) Assignee: Teh Yor Co., Ltd., New Taipei (TW)

( * ) Notice: Subject to any disclaimer, the term of this patent is extended or adjusted under 35 U.S.C. 154(b) by 111 days.

(21) Appl. No.: 17/110,790

(22) Filed: Dec. 3, 2020

(65) Prior Publication Data

US 2021/0172246 A1 Jun. 10, 2021

Related U.S. Application Data

(60) Provisional application No. 62/943,484, filed on Dec. 4, 2019.

(51) Int. Cl.
*E06B 9/262* (2006.01)

(52) U.S. Cl.
CPC ..... *E06B 9/262* (2013.01); *E06B 2009/2622* (2013.01); *E06B 2009/2627* (2013.01)

(58) Field of Classification Search
CPC .. E06B 9/262; E06B 2009/2622; E06B 9/322; E06B 2009/2627; E06B 2009/3222;
(Continued)

(56) References Cited

U.S. PATENT DOCUMENTS 5,119,868 A * 6/1992 Werner ..... E06B 9/307 160/115
7,143,802 B2 * 12/2006 Strand ..... E06B 9/60 160/167 R
(Continued)

FOREIGN PATENT DOCUMENTS

CN 103168146 A 6/2013
EP 2305943 A2 4/2011
(Continued)

OTHER PUBLICATIONS

International Search Report in the related PCT application No. PCT/US2020/063008, dated Mar. 22, 2021.
(Continued)

*Primary Examiner* — Abe Massad
(74) *Attorney, Agent, or Firm* — Chen Yoshimura LLP

(57) ABSTRACT

An actuating system for a window shade includes a first rotary axle rotatable for displacing a bottom part, a second rotary axle rotatable for displacing an intermediate rail, and a limiting mechanism including a first and a second sliding part respectively linked movably to the first and second rotary axle. The first sliding part slides in a first direction when the first rotary axle rotates for lowering the bottom part and in a second direction when the first rotary axle rotates for raising the bottom part. The second sliding part slides in the first direction when the second rotary axle rotates for lowering the intermediate rail and in the second direction when the second rotary axle rotates for raising the intermediate rail. The first sliding part is prevented from sliding in the second direction via a contact between the first sliding part and the second sliding part.

19 Claims, 20 Drawing Sheets

(58) Field of Classification Search
CPC ..... E06B 2009/3225; E06B 9/30; E06B 9/32; E06B 9/90; E06B 9/88; E06B 2009/2625
See application file for complete search history.

(56) References Cited

U.S. PATENT DOCUMENTS

| | | | | |
|---|---|---|---|---|
| 8,752,607 | B2 * | 6/2014 | Anderson | E06B 9/262 160/171 |
| 2004/0074611 | A1 * | 4/2004 | Colson | E06B 9/64 160/84.05 |
| 2008/0223532 | A1 * | 9/2008 | Auger | E06B 9/262 160/307 |
| 2011/0265962 | A1 | 11/2011 | Drew et al. | |
| 2015/0144275 | A1 * | 5/2015 | Ganzi | E06B 9/382 160/84.03 |
| 2018/0363370 | A1 * | 12/2018 | Cheng | E06B 9/90 |
| 2019/0234140 | A1 * | 8/2019 | Valkenburg | E06B 9/262 |
| 2021/0230939 | A1 * | 7/2021 | Otsuka | E06B 9/262 |

FOREIGN PATENT DOCUMENTS

| | | | | |
|---|---|---|---|---|
| JP | 2020020132 | A | * | 2/2020 |
| WO | 2011/137205 | A1 | | 11/2011 |
| WO | 2012/150946 | A2 | | 11/2012 |

OTHER PUBLICATIONS

Written Opinion in the related PCT application No. PCT/US2020/063008, dated Mar. 22, 2021.
Taiwanese Office Action, dated Jun. 10, 2021, in a counterpart Taiwanese patent application, No. TW 109142686. (English translation of the search report is attached.).

* cited by examiner

100

100

142

142

WINDOW SHADE AND ACTUATING SYSTEM THEREOF

CROSS-REFERENCE TO RELATED APPLICATION(S)

This application claims priority to U.S. provisional patent application No. 62/943,484 filed on Dec. 4, 2019, the disclosure of which is incorporated herein by reference.

BACKGROUND

1. Field of the Invention

The present invention relates to window shades, and actuating systems used in window shades.

2. Description of the Related Art

Some window shades may have a bottom rail and an intermediate rail that can be adjusted independent of each other. This type of window shades can offer differential light transmission regions above and below the intermediate rail. However, the ability to separately displace the bottom rail and the intermediate rail may result in undesirable interaction between the bottom rail and the intermediate rail during operation if no adequate restricting mechanisms were provided. Moreover, the window shade may undesirably rise if the user continues operating after the window shade reaches a lowest position.

Therefore, there is a need for an improved actuating system that can be used in window shades and address at least the foregoing issues.

SUMMARY

The present application describes a window shade and an actuating system for use with the window shade that can address the foregoing issues.

According to an embodiment, the actuating system includes a first rotary axle and a second rotary axle rotatable independent of each other, the first rotary axle being rotatable for displacing a bottom part of a window shade, and the second rotary axle being rotatable for displacing an intermediate rail of a window shade, and a limiting mechanism including a mount support, and a first and a second sliding part respectively connected with the mount support, the first sliding part being movably linked to the first rotary axle, and the second sliding part being movably linked to the second rotary axle. The first sliding part slides in a first direction when the first rotary axle rotates for lowering the bottom part and in a second direction opposite to the first direction when the first rotary axle rotates for raising the bottom part, the second sliding part slides in the first direction when the second rotary axle rotates for lowering the intermediate rail and in the second direction when the second rotary axle rotates for raising the intermediate rail, and the first sliding part is prevented from sliding in the second direction via a contact between the first sliding part and the second sliding part.

Moreover, the application describes a window shade that incorporates the actuating system.

DETAILED DESCRIPTION OF THE EMBODIMENTS

Figure 1:
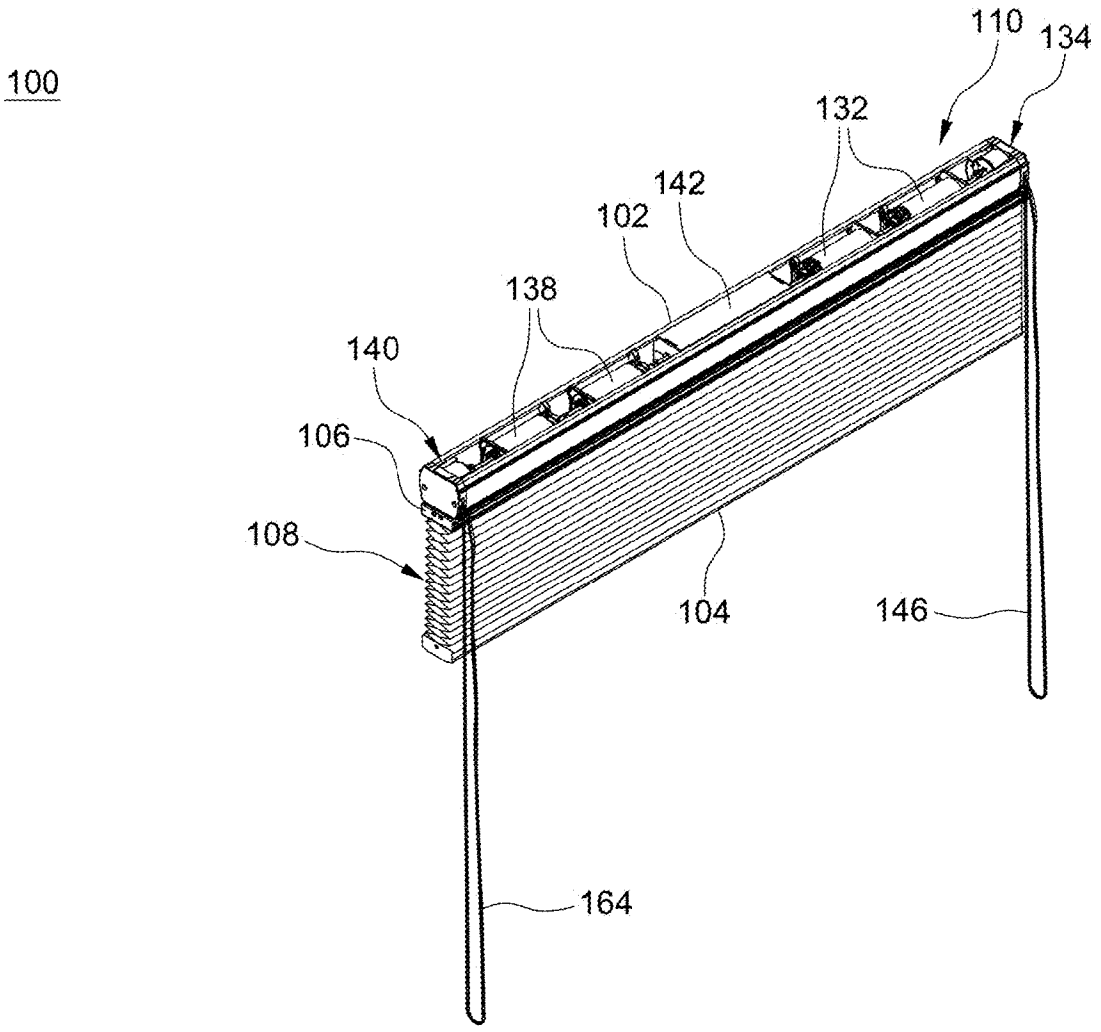
FIG. 1 is a perspective view illustrating an embodiment of a window shade.
Figure 2:
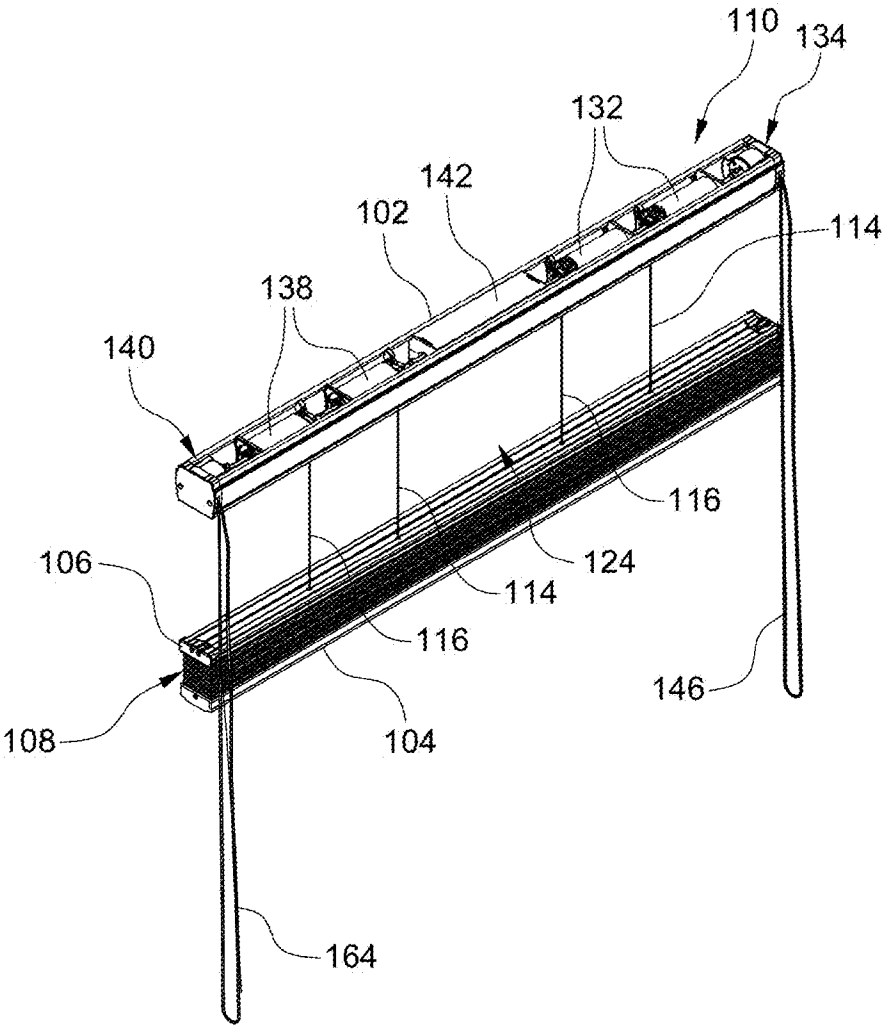
FIG. 2 is a perspective view illustrating the window shade having a bottom part and an intermediate rail lowered from a head rail.
Figure 3:
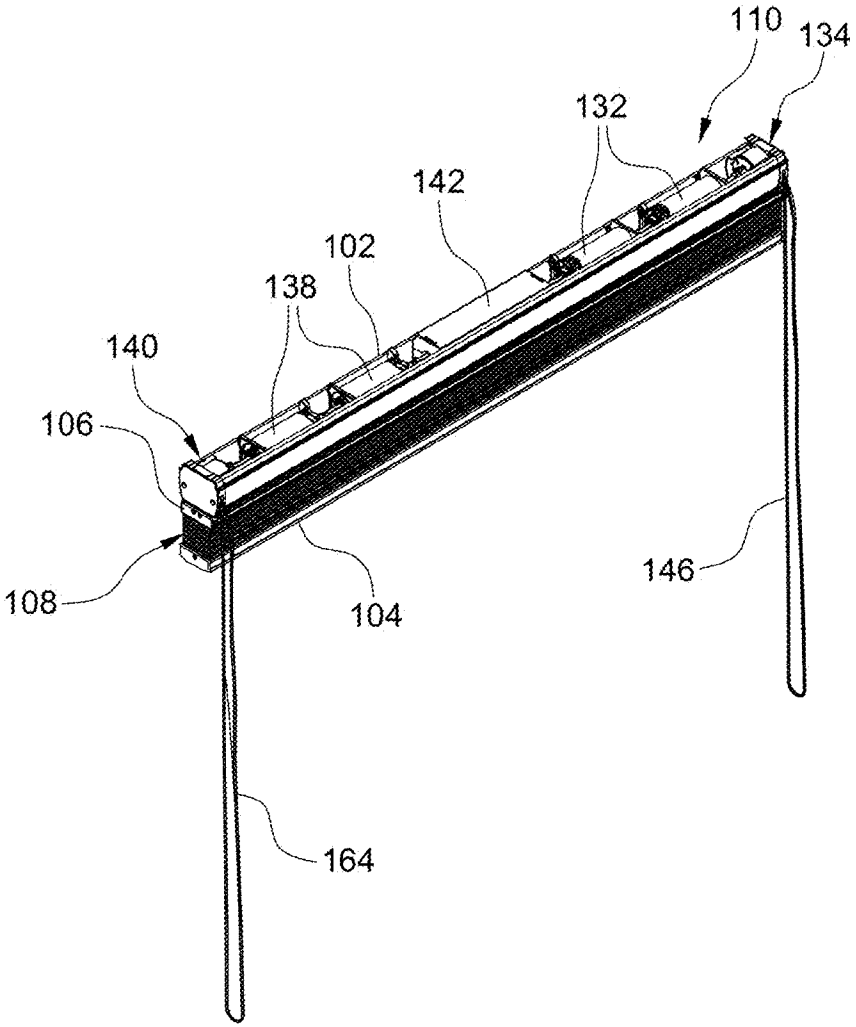
FIG. 3 is a perspective view illustrating the window shade with the bottom part and the intermediate rail in a fully raised configuration.
Figure 4:
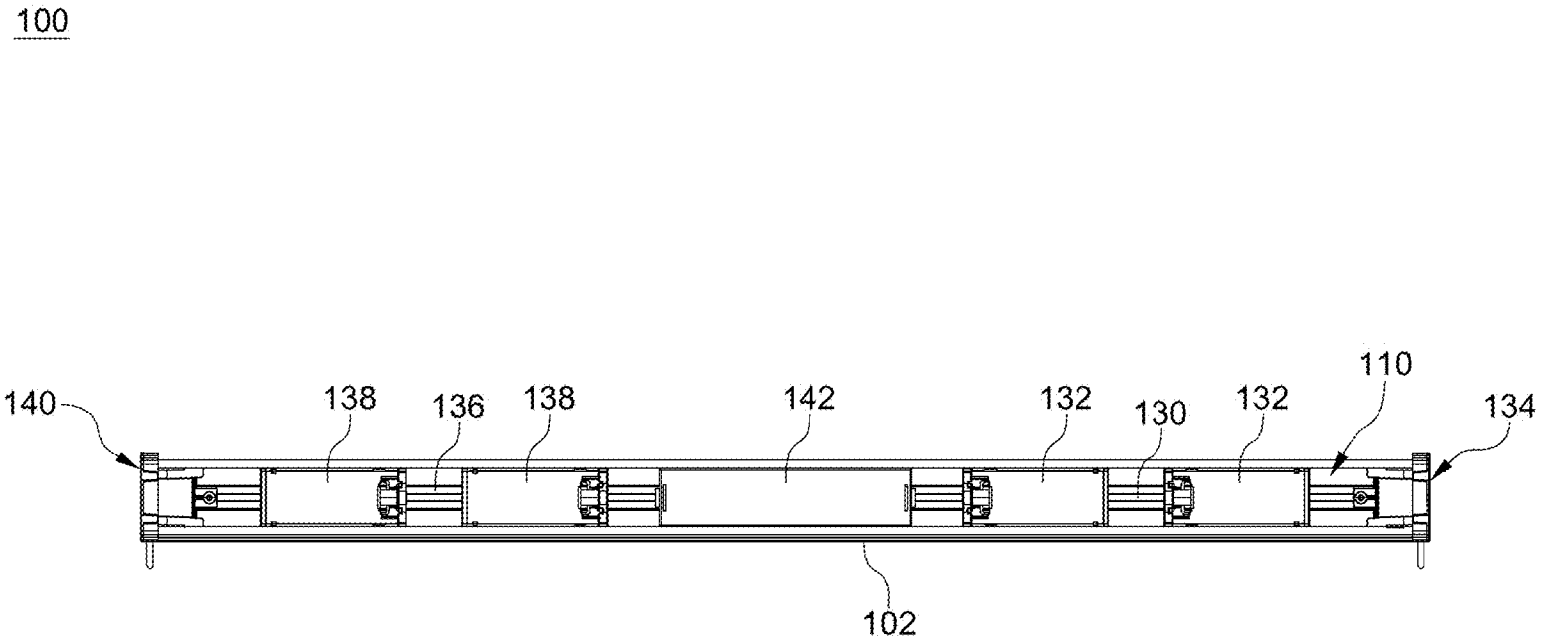
FIG. 4 is a top view of the window shade.
Figure 5:
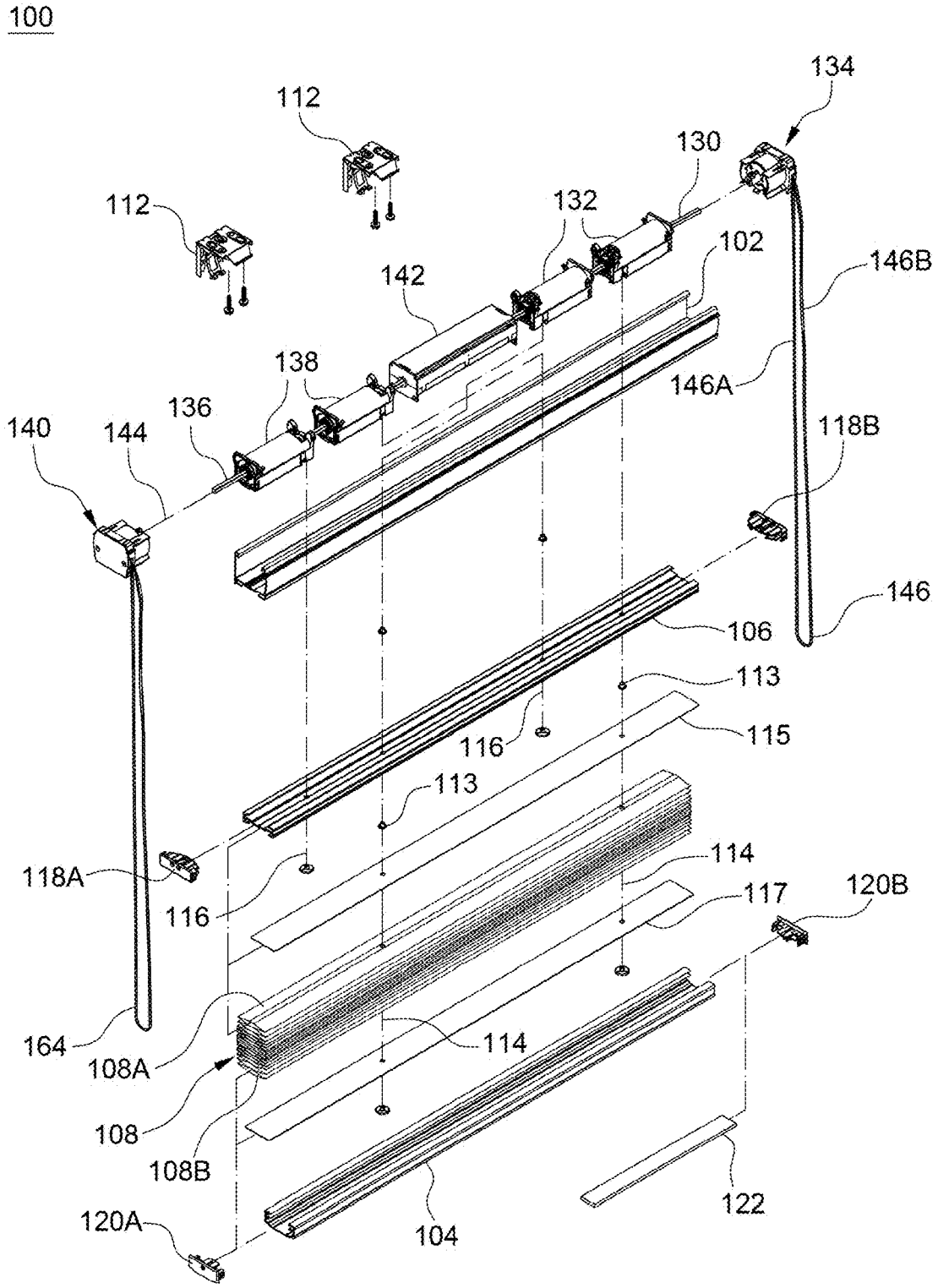
FIG. 5 is an exploded view illustrating a construction of the window shade.

FIGS. 1-3 are perspective views respectively illustrating an embodiment of a window shade 100 in different states, FIG. 4 is a top view of the window shade 100, and FIG. 5 is an exploded view of the window shade 100. Referring to FIGS. 1-5, the window shade 100 can include a head rail 102, a bottom part 104, an intermediate rail 106, a shading structure 108 and an actuating system 110.

The head rail 102 may be affixed at a top of a window frame, and can have any desirable shapes. According to an example of construction, the head rail 102 can have an elongate shape including a cavity for at least partially receiving the actuating system 110 of the window shade 100. When the window shade 100 is installed on a window, attachment brackets 112 can be used to affix the head rail 102 on a window frame.

The bottom part 104 can be suspended from the head rail 102 with a plurality of suspension cords 114. According to an example of construction, the bottom part 104 may be an elongate rail having a channel adapted to receive to the attachment of the shading structure 108.

The intermediate rail 106 can be disposed between the head rail 102 and the bottom part 104, and can be suspended from the head rail 102 with a plurality of suspension cords 116. The intermediate rail 106 may also have an elongate shape having a channel adapted to receive an attachment of the shading structure 108. Moreover, a plurality of guiding elements 113 may be provided in the intermediate rail 106 for facilitating the passage of the suspension cords 114 through the intermediate rail 106. The guiding elements 113 may exemplary include grommets affixed to the intermediate rail 106.

The shading structure 108 may exemplary have a cellular structure, which may include, without limitation, honeycomb structures. However, it will be appreciated that the shading structure 108 may have any suitable structure that can be expanded and collapsed between the bottom part 104 and the intermediate rail 106. The shading structure 108 is disposed between the intermediate rail 106 and the bottom part 104, and has two opposite ends 108A and 108B respectively disposed adjacent to the intermediate rail 106 and the bottom part 104. For example, the end 108A of the shading structure 108 may be provided with a strip 115 that is engaged with the intermediate rail 106 so as to attach the end 108A of the shading structure 108 to the intermediate rail 106, and the other end 108B of the shading structure 108 may be likewise attached to the bottom part 104 via a strip 117. Two end caps 118A and 118B may respectively close two opposite ends of the intermediate rail 106 so as to restrain the strip 115 inside the intermediate rail 106, and two end caps 120A and 120B may respectively close two opposite ends of the bottom part 104 so as to retrain the strip 117 inside the bottom part 104. According to an example of construction, the bottom part 104 may further carry a weighing element 122 for improved stability during use.

Referring to FIGS. 1-3, each of the bottom part 104 and the intermediate rail 106 is independently movable vertically relative to the head rail 102 for setting the window shade 100 to a desirable configuration. For example, the bottom part 104 may be lowered away from the head rail 102 and the intermediate rail 106 to expand the shading structure 108 as shown in FIG. 1, or raised toward the head rail 102 and the intermediate rail 106 to collapse the shading structure 108 as shown in FIG. 3. Moreover, the bottom part 104 and the intermediate rail 106 may be lowered away from the head rail 102 to form a gap 124 for light passage between the head rail 102 and the intermediate rail 106, as shown in FIG. 2. The vertical position of the bottom part 104 and the vertical position of the intermediate rail 106 relative to the head rail 102 may be controlled with the actuating system 110.

Referring to FIGS. 1-5, the actuating system 110 is assembled with the head rail 102, and is operable to displace the bottom part 104 and the intermediate rail 106 relative to the head rail 102 for adjustment. The actuating system 110 can include a rotary axle 130 and a plurality of cord winding units 132 rotationally coupled to the rotary axle 130, a control module 134 operatively coupled to the rotary axle 130, a rotary axle 136 and a plurality of cord winding units 138 rotationally coupled to the rotary axle 136, a control module 140 operatively coupled to the rotary axle 136, and a limiting mechanism 142 respectively coupled to the rotary axles 130 and 136.

The rotary axle 130 is respectively coupled to the cord winding units 132, and can rotate about a rotation axis 144. Each of the cord winding units 132 is respectively connected with the bottom part 104 via one suspension cord 114, and is operable to wind the suspension cord 114 for raising the bottom part 104 and to unwind the suspension cord 114 for lowering the bottom part 104. For example, the cord winding unit 132 may include a rotary drum (not shown) that is rotationally coupled to the rotary axle 130 and is connected with one end of the suspension cord 114, and another end of the suspension cord 114 can be connected with the bottom part 104, whereby the rotary drum can rotate along with the rotary axle 130 to wind or unwind the suspension cord 114. Since the cord winding units 132 are commonly coupled to the rotary axle 130, the cord winding units 132 can operate in a concurrent manner for winding and unwinding the suspension cords 114.

The control module 134 is coupled to the rotary axle 130, and is operable to drive the rotary axle 130 to rotate in either direction about the rotation axis 144 for raising or lowering the bottom part 104. According to an example of construction, the control module 134 includes an operating member 146 that can hang downward from the head rail 102 and is operable to cause the rotary axle 130 to rotate in either direction for raising or lowering the bottom part 104. The operating member 146 can have a looped structure, which can include, without limitation, a looped bead chain, a looped cord, and the like.

Figure 6:
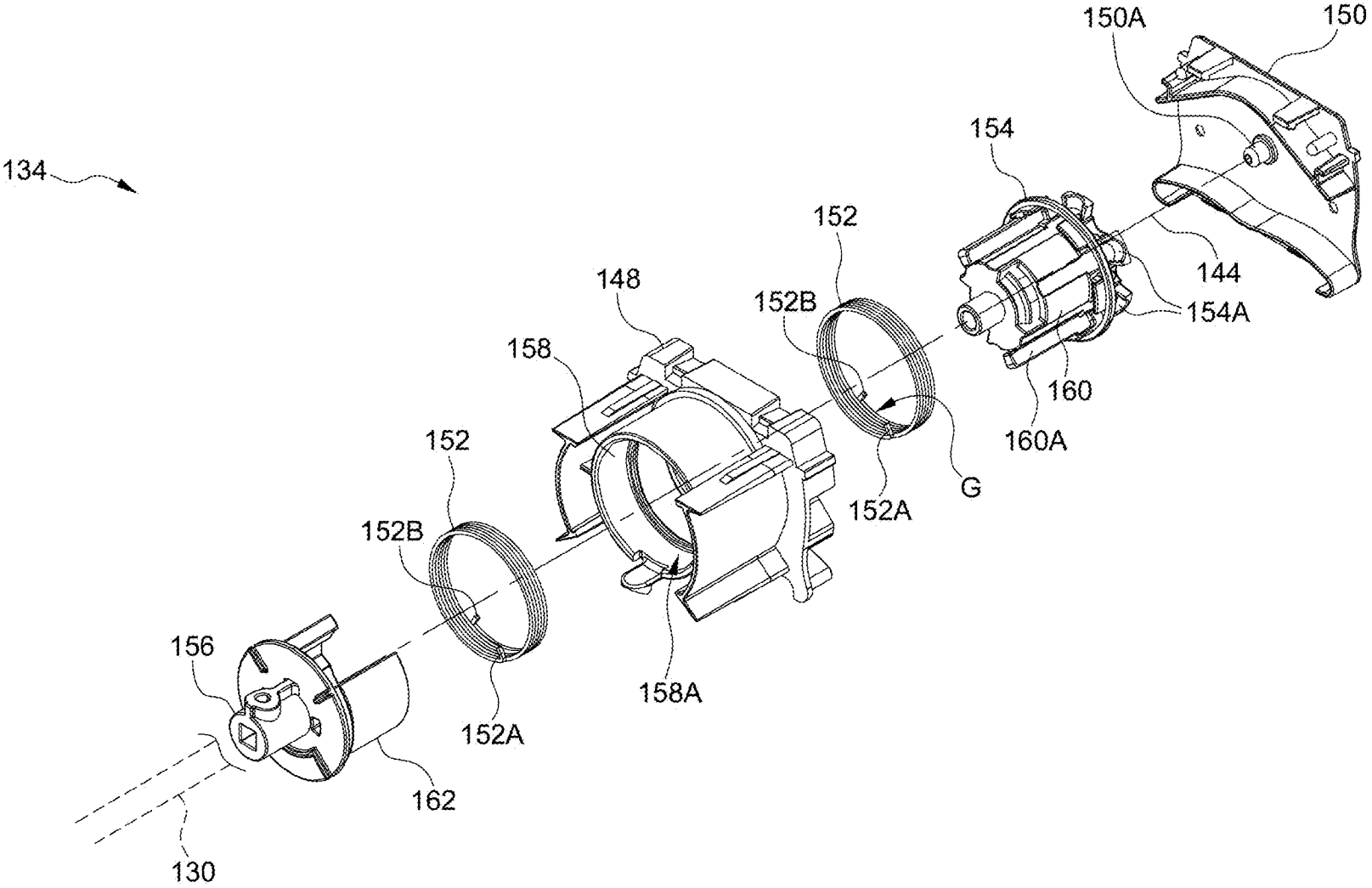
FIG. 6 is an exploded view illustrating a construction of a control module provided in an actuating system of the window shade.
Figure 7:
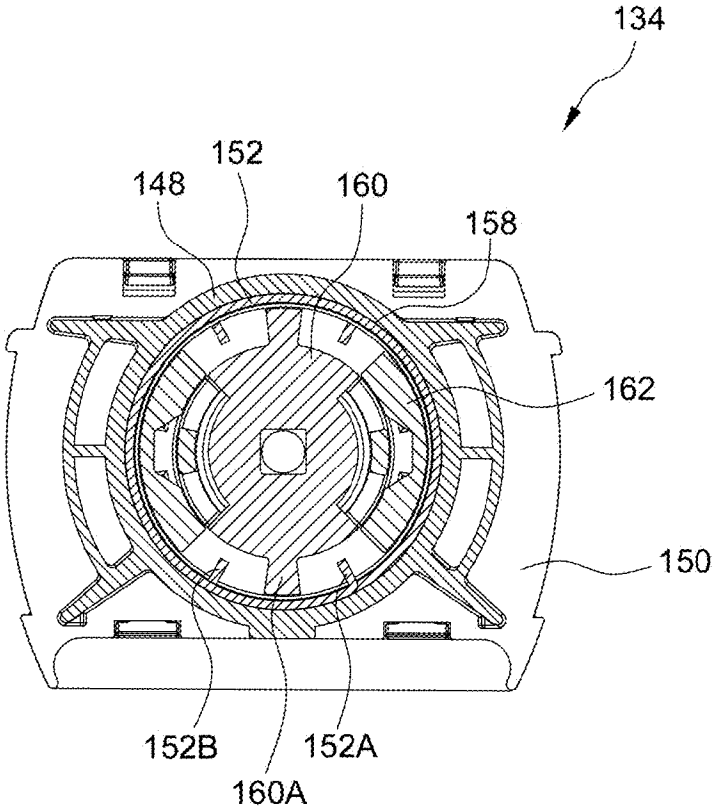
FIG. 7 is a cross-sectional view of the control module shown in FIG. 6.

In conjunction with FIGS. 1-5, FIG. 6 is an exploded view illustrating a construction of the control module 134, and FIG. 7 is a cross-sectional view of the control module 134. Referring to FIGS. 1-7, the control module 134 can include the operating member 146, a housing 148, a bracket 150, one or more spring 152, a wheel 154, and an axle coupling part 156.

The housing 148 can have an inner wall 158 that delimits an inner cavity 158A adapted to receive the spring 152. The bracket 150 can be fixedly connected with the housing 148, and can close one side of the inner cavity 158A. The control module 134 can be mounted to the head rail 102 with the housing 148 and the bracket 150 fixedly attached to the head rail 102.

Each spring 152 can be a torsion spring having two prongs 152A and 152B spaced apart from each other, and can be assembled inside the housing 148 in tight contact with the inner wall 158 and around the rotation axis 144. Each of the two prongs 152A and 152B can be respectively pushed in one direction for causing the spring 152 to contract and loosen its frictional contact with the inner wall 158 of the housing 148, and in an opposite direction for causing the spring 152 to further expand and tighten its frictional contact with the inner wall 158 of the housing 148.

The wheel 154 can be pivotally connected with the bracket 150 so as to be rotatable about the rotation axis 144 relative to the housing 148 and the bracket 150. For example, the bracket 150 can be fixedly connected with a shaft portion 150A, and the wheel 154 can be pivotally connected about the shaft portion 150A. Moreover, the wheel 154 may have a circumference configured to engage with the operating member 146. In the illustrated embodiment, the operating member 146 is exemplary a bead chain, and the circumference of the wheel 154 may include a plurality of notches 154A that can engage with the bead chain. Pulling on the operating member 146 thus can drive the wheel 154 to rotate in either direction. For example, the operating member 146 may have an outer portion 146A and an inner portion 146B, and pulling downward one of the outer and inner portions 146A and 146B may drive the wheel 154 to rotate in one direction while pulling downward the other one of the outer and inner portions 146A and 146B may drive the wheel 154 to rotate in an opposite direction.

The wheel 154 can further be fixedly connected with an actuating part 160 having a rib 160A, whereby the wheel 154 and the actuating part 160 are rotatable in unison. According to an example of construction, the actuating part 160 may be fastened to the wheel 154. According to another example of construction, the actuating part 160 may be formed integrally with the wheel 154. The actuating part 160 can axially protrude at a side of the wheel 154, and can extend through the spring 152 with the rib 160A positioned in a gap G between the two prongs 152A and 152B of the spring 152. Accordingly, a rotation of the wheel 154 in either direction can result in the rib 160A selectively pushing against one of the two prongs 152A and 152B for causing the spring 152 to contract and loosen its frictional contact with the inner wall 158 of the housing 148. For example, the rib 160A can push against the prong 152A of the spring 152 for causing the spring 152 to loosen when the wheel 154 rotates in one direction, and the rib 160A can push against the prong 152B of the spring 152 for causing the spring 152 to loosen when the wheel 154 rotates in another opposite direction.

Referring to FIGS. 5 and 6, the axle coupling part 156 can be rotationally coupled to the rotary axle 130, and can have a tongue 162 that extends through the spring 152 and at least partially around the rotation axis 144. The tongue 162 is located outside the gap G between the two prongs 152A and 152B of the spring 152 so that a rotation of the rotary axle 130 and the axle coupling part 156 in either direction can result in the tongue 162 selectively pushing against one of the two prongs 152A and 152B for causing the spring 152 to expand and tighten its frictional contact with the inner wall 158 of the housing 148.

For lowering the bottom part 104, a user can pull downward one of the outer portion 146A and the inner portion 146B of the operating member 146 (e.g., the outer portion 146A), which urges the wheel 154 to rotate in one direction and causes the rib 160A of the actuating part 160 to push against one of the two prongs 152A and 152B for causing the spring 152 to contract and loosen its frictional contact with the inner wall 158 of the housing 148. The loosened spring 152 then can rotate along with the wheel 154 and push against the tongue 162 of the axle coupling part 156, which consequently causes the axle coupling part 156 and the rotary axle 130 to rotate in unison in the same direction along with the spring 152 and the wheel 154 for lowering the bottom part 104.

For raising the bottom part 104, a user can pull downward the other one of the outer portion 146A and the inner portion 146B of the operating member 146 (e.g., the inner portion 146B), which urges the wheel 154 to rotate in an opposite direction and cause the rib 160A of the actuating part 160 to push against the other one of the two prongs 152A and 152B for causing the spring 152 to contract and loosen its frictional contact with the inner wall 158 of the housing 148. The loosened spring 152 then can likewise rotate along with the wheel 154 and push against the tongue 162 of the axle coupling part 156, which consequently causes the axle coupling part 156 and the rotary axle 130 to rotate in unison in the same direction along with the spring 152 and the wheel 154 for raising the bottom part 104.

When the operating member 146 is not operated and the wheel 154 remains stationary, the suspended weight of the bottom part 104 and the shading structure 108 can apply a torque on the axle coupling part 156 and the rotary axle 130, which biases the tongue 162 to push against one of the two prongs 152A and 152B of the spring 152 for causing the spring 152 to expand and increase its frictional contact with the inner wall 158 of the housing 148. This frictional contact between the spring 152 and the housing 148 can block rotation of the spring 152, the axle coupling part 156 and the rotary axle 130 about the rotation axis 144 and keep the bottom part 104 at any desirable positions, such as the different positions shown in FIGS. 1-3.

Referring to FIGS. 1-7, the rotary axle 136 is respectively coupled to the cord winding units 138, and can rotate independent of the rotary axle 130. According to an example of construction, the rotary axle 136 can be disposed substantially coaxial to the rotary axle 130, and can rotate about the same rotation axis 144. For example, the rotary axles 130 and 136 may be spaced apart from each other along the rotation axis 144. Each of the cord winding units 138 is respectively connected with the intermediate rail 106 via one suspension cord 116, and is operable to wind the suspension cord 116 for raising the intermediate rail 106 and to unwind the suspension cord 116 for lowering the intermediate rail 106. For example, the cord winding unit 138 may include a rotary drum (not shown) that is rotationally coupled to the rotary axle 136 and is connected with one end of the suspension cord 116, and another end of the suspension cord 116 can be connected with the intermediate rail 106, whereby the rotary drum can rotate along with the rotary axle 136 to wind or unwind the suspension cord 116. Since the cord winding units 138 are commonly coupled to the rotary axle 136, the cord winding units 138 can operate in a concurrent manner for winding and unwinding the suspension cords 116.

The control module 140 is coupled to the rotary axle 136, and is operable independently of the control module 134 to drive the rotary axle 136 to rotate in either direction about the rotation axis 144 for raising or lowering the intermediate rail 106. According to an example of construction, the control module 140 includes an operating member 164 that can hang downward from the head rail 102 and is operable to cause the rotary axle 136 to rotate in either direction for raising or lowering the intermediate rail 106. The operating member 164 can have a looped structure, which can include, without limitation, a looped bead chain, a looped cord, and the like. The control module 140 may be similar to the control module 134 in construction, and the two control modules 134 and 140 may be respectively disposed at two opposite ends of the head rail 102.

In conjunction with FIGS. 1-5, FIGS. 8 and 9 are respectively an exploded view and a cross-sectional view illustrating a construction of the limiting mechanism 142. Referring to FIGS. 1-5, 8 and 9, the limiting mechanism 142 can include a mount support 166, a sliding part 168 and an extension part 170 coupled to the rotary axle 130, and a sliding part 172 and an extension part 174 coupled to the rotary axle 136.

Figure 10:
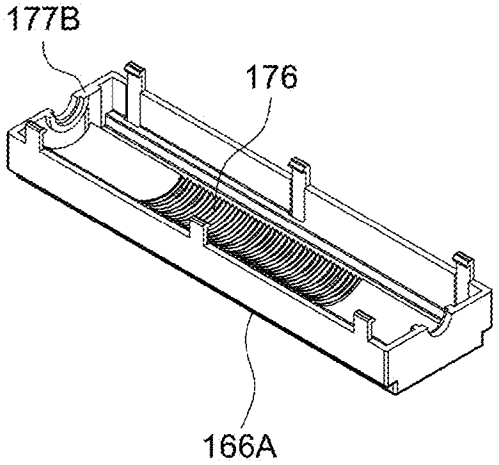
FIG. 10 is a perspective view illustrating a casing portion provided in the limiting mechanism.

The mount support 166 can receive the sliding parts 168 and 172, and can be fixedly connected with the head rail 102. According to an example of construction, the mount support 166 may be a housing including two casing portions 166A and 166B that can be fixedly attached to each other to define a hollow interior adapted to receive the sliding parts 168 and 172. FIG. 10 is a perspective view illustrating the casing portion 166A alone.

Figure 8:
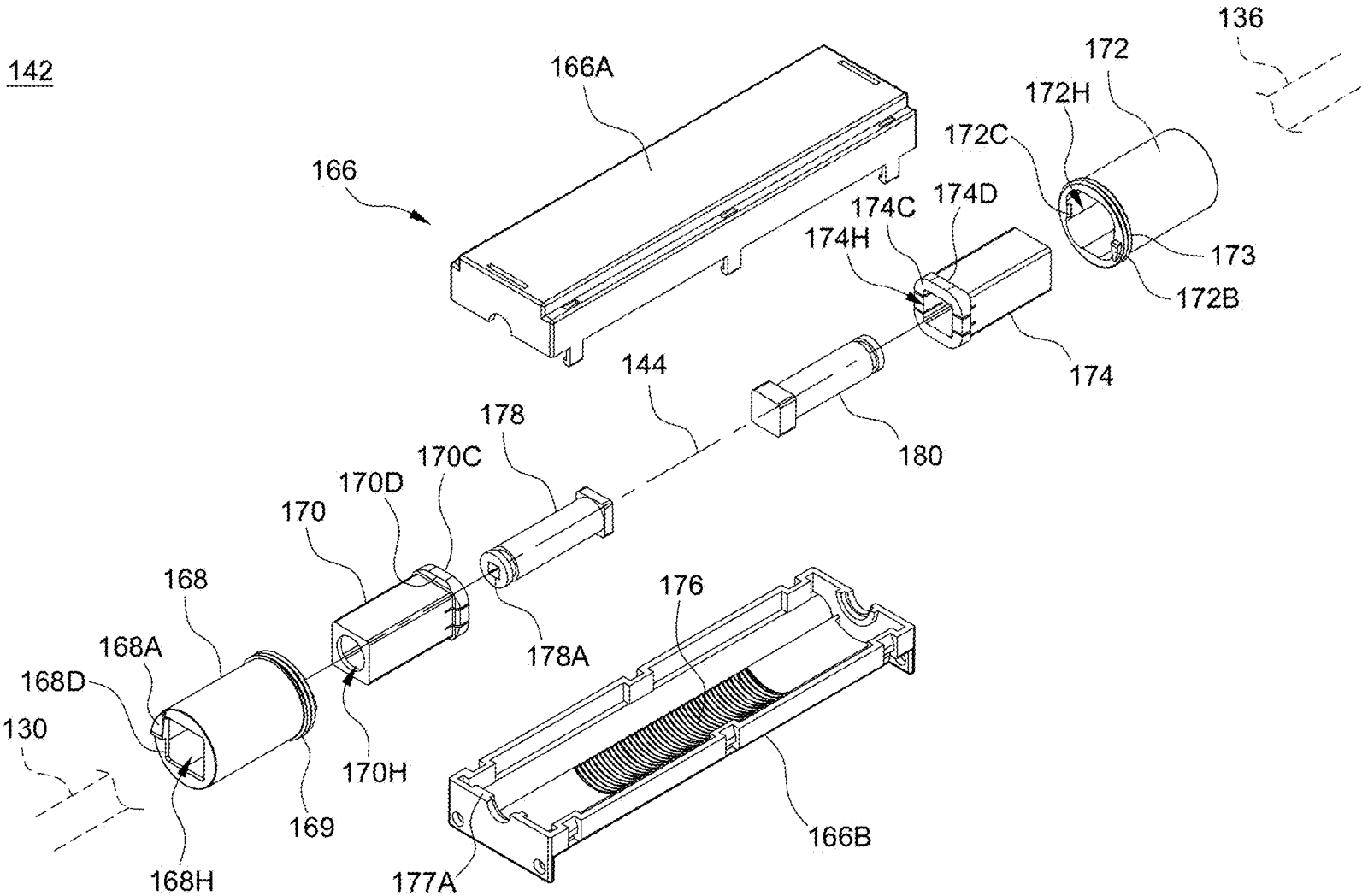
FIG. 8 is an exploded view illustrating a limiting mechanism provided in the actuating system of the window shade.
Figure 9:
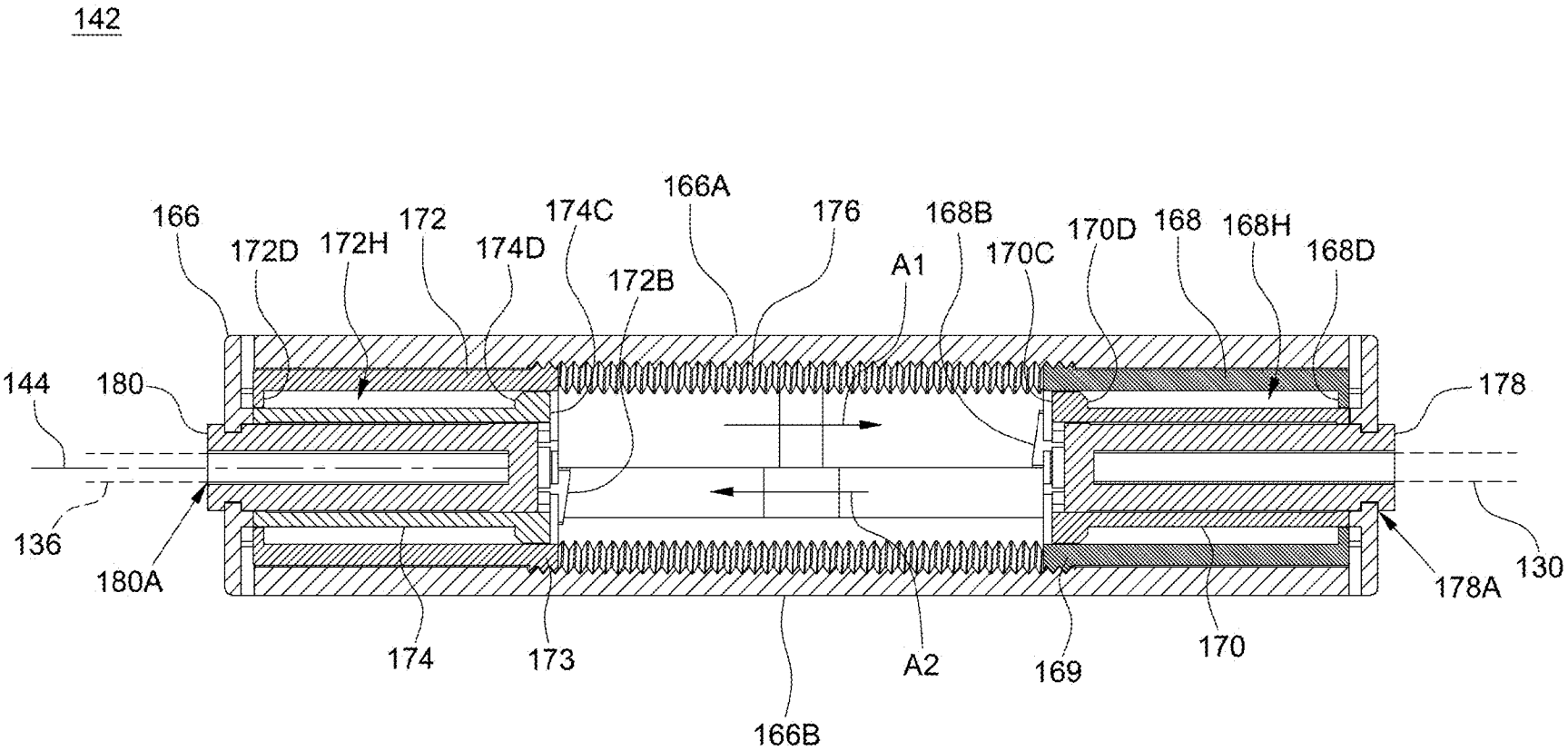
FIG. 9 is a cross-sectional view of the limiting mechanism shown in FIG. 8.
Figure 11:
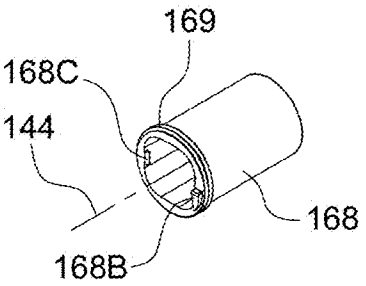
FIG. 11 is a perspective view illustrating a sliding part provided in the limiting mechanism.

In conjunction with FIGS. 8 and 9, FIG. 11 is a perspective view illustrating the sliding part 168 alone under an angle of view differing from that of FIG. 8. Referring to FIGS. 8, 9 and 11, the sliding part 168 is connected with the mount support 166, and is movably linked to the rotary axle 130 so that a rotation of the rotary axle 130 causes the sliding part 168 to slide along the rotation axis 144 relative to the mount support 166. For example, the sliding part 168 can be rotationally coupled to the rotary axle 130 and axially slidable relative to the rotary axle 130, and can have a threaded portion 169 engaged with a threaded portion 176 provided in the mount support 166. The threaded portions 169 and 176 can be exemplarily formed on a circular or arcuate surface having an axis substantially coaxial to the rotation axis 144. This connection allows the sliding part 168 to concurrently rotate about and slide along the rotation axis 144 as the rotary axle 130 rotates about the rotation axis 144.

Figure 12:
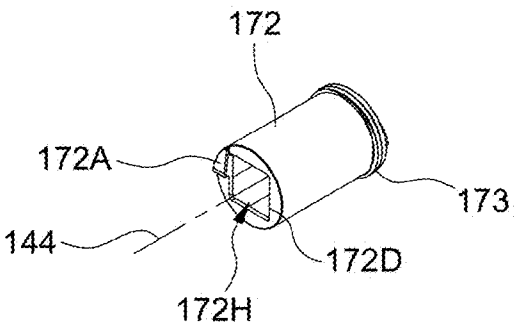
FIG. 12 is a perspective view illustrating another sliding part provided in the limiting mechanism.

In conjunction with FIGS. 8 and 9, FIG. 12 is a perspective view illustrating the sliding part 172 alone under an angle of view differing from that of FIG. 8. Referring to FIGS. 8, 9 and 12, the sliding part 172 is also connected with the mount support 166, and is movably linked to the rotary axle 136 so that a rotation of the rotary axle 136 causes the sliding part 172 to slide along the rotation axis 144 relative to the mount support 166. For example, the sliding part 172 can be rotationally coupled to the rotary axle 136 and axially slidable relative to the rotary axle 136, and can have a threaded portion 173 engaged with the threaded portion 176 of the mount support 166. The threaded portion 173 can be exemplarily formed on a circular or arcuate surface having an axis substantially coaxial to the rotation axis 144. This connection allows the sliding part 172 to concurrently rotate about and slide along the rotation axis 144 as the rotary axle 136 rotates about the rotation axis 144.

With the aforementioned construction, the sliding part 168 can slide in a direction A1 away from the sliding part 172 when the rotary axle 130 rotates for lowering the bottom part 104 and in a direction A2 (i.e., opposite to the direction A1) toward the sliding part 172 when the rotary axle 130 rotates for raising the bottom part 104. The sliding part 172 can slide in the direction A1 toward the sliding part 168 when the rotary axle 136 rotates for lowering the intermediate rail 106 and in the direction A2 away from the sliding part 168 when the rotary axle 136 rotates for raising the intermediate rail 106. The sliding part 168 can thereby have a course that can be delimited by the sliding part 172 and a stop structure 177A provided in the mount support 166, wherein the stop structure 177A may be provided on an inner sidewall of the mount support 166 (e.g., on the casing portion 166B of the mount support 166). This course of the sliding part 168 can correspond to a vertical course of the bottom rail 104 between a lowest position relative to the head rail 102 and the intermediate rail 106. Correspondingly, the sliding part 172 can have a course that can be delimited by the sliding part 168 and another stop structure 177B provided in the mount support 166, wherein the stop structure 177B may be provided on an inner sidewall of the mount support 166 (e.g., on the casing portion 166A of the mount support 166) opposite to the stop structure 177A. This course of the sliding part 172 can correspond to a vertical course of the intermediate rail 106 between the bottom part 104 and a highest position of the intermediate rail 106 relative to the head rail 102.

With the limiting mechanism 142 described herein, a contact between the sliding part 168 and the stop structure 177A can prevent the bottom part 104 from moving downward relative to the head rail 102, and can thereby stop the bottom part 104 at the lowest position relative to the head rail 102. For facilitating an engagement of the sliding part 168 with the strop structure 177A, the sliding part 168 may have a protrusion 168A eccentric from the rotation axis 144 that is provided at one end of the sliding part 168, which can contact and engage the strop structure 177A to stop the bottom part 104 at the lowest position. Moreover, a contact between the sliding part 172 and the stop structure 177B or a position of the sliding part 172 adjacent to the stop structure 177B may correspond to a highest position of the intermediate rail 106 adjacent to the head rail 102. For facilitating an engagement of the sliding part 172 with the strop structure 177B, the sliding part 172 may have a protrusion 172A (better shown in FIG. 12) eccentric from the rotation axis 144 that is provided at one end of the sliding part 172, which may contact and engage the strop structure 177B to stop the intermediate rail 106 at its highest position.

On the other hand, a contact between the sliding part 168 and the sliding part 172 can prevent the sliding part 168 from sliding in the direction A2, which can stop the bottom rail 104 at a suitable distance from the intermediate rail 106 and prevent an upward displacement of the bottom part 104 that would undesirably push the intermediate rail 106 upward. The contact between the sliding part 168 and the sliding part 172 can also prevent the sliding part 172 from sliding in the direction A1, which can stop the intermediate rail 106 at a suitable distance from the bottom rail 104 and prevent a downward displacement of the intermediate rail 106 that would undesirably push the bottom part 104 downward. For facilitating an engagement between the sliding parts 168 and 172, the sliding part 168 may have a protrusion 168B (better shown in FIG. 11) eccentric from the rotation axis 144 that is provided at another end of the sliding part 168 opposite to that of the protrusion 168A, and the sliding part 172 may have a protrusion 172B (better shown in FIG. 8) eccentric from the rotation axis 144 that is provided at another end of the sliding part 172 opposite to that of the protrusion 172A. The contact between the sliding part 168 and the sliding part 172 may be achieved via an engagement of the protrusion 168B with the protrusion 172B.

Referring to FIGS. 8 and 9, the extension part 170 can be provided for extending the course of the sliding part 168 (and thus the vertical course of the bottom part 104), wherein the sliding part 168 can be rotationally coupled to the rotary axle 130 via the extension part 170. According to an example of construction, the rotary axle 130 can have a coupling portion 178, and the extension part 170 can be respectively connected slidably with the sliding part 168 and the coupling portion 178 of the rotary axle 130. The coupling portion 178 can be connected with an end of the rotary axle 130 for facilitating the assembly of the extension part 170, and is rotatable in unison with the rotary axle 130. For example, the end of the rotary axle 130 can be received in an opening 178A provided in the coupling portion 178 so as to rotationally couple the coupling portion 178 to the rotary axle 130. According to another example of construction, the coupling portion 178 may be formed integrally with the rotary axle 130.

According to an example of construction, the sliding part 168, the extension part 170 and the coupling portion 178 can be telescopically connected with one another. For example, the sliding part 168 can have a hollow interior 168H in which a portion of the extension part 170 having a matching shape is slidably disposed, and the extension part 170 can have a hollow interior 170H in which a portion of the coupling portion 178 having a matching shape is slidably disposed. With the construction described herein, the sliding part 168 and the extension part 170 can rotate in unison along with the coupling portion 178 and the rotary axle 130 about the rotation axis 144, and meanwhile slide along the rotation axis 144 relative to each other and the coupling portion 178 of the rotary axle 130. For example, the extension part 170 is slidable relative to the coupling portion 178 along the rotation axis 144 of the rotary axle 130 in the directions A1 and A2, and the sliding part 168 is slidable relative to the extension part 170 and the coupling portion 178 along the rotation axis 144 of the rotary axle 130 in the directions A1 and A2.

Referring to FIGS. 8, 9 and 11, an engagement structure may be provided for allowing the extension part 170 to slide along with the sliding part 168 in the directions A1 and A2 for retraction and extension relative to the coupling portion 178. For example, this engagement structure may include two protrusions 168C and 168D provided on the sliding part 168 axially distant from each other, and a flange provided at one end of the extension part 170 that defines two opposite flange surfaces 170C and 170D. The sliding part 168 and the extension part 170 can slide in unison in the direction A1 relative to the coupling portion 178 with the protrusion 168C in contact with the flange surface 170C, and the protrusion 168C can be displaced away from the flange surface 170C when the sliding part 168 slides in the direction A2 relative to the extension part 170 and the coupling portion 178. Moreover, the sliding part 168 and the extension part 170 can slide in unison in the direction A2 relative to the coupling portion 178 with the protrusion 168D in contact with the flange surface 170D, and the protrusion 168D can be displaced away from the flange surface 170D when the sliding part 168 slides in the direction A1 relative to the extension part 170 and the coupling portion 178.

Referring to FIGS. 8 and 9, the extension part 174 can be likewise provided for extending the course of the sliding part 172 (and thus the vertical course of the intermediate rail 106), wherein the sliding part 172 can be rotationally coupled to the rotary axle 136 via the extension part 174. According to an example of construction, the rotary axle 136 can have a coupling portion 180, and the extension part 174 can be respectively connected slidably with the sliding part 172 and the coupling portion 180 of the rotary axle 136. The coupling portion 180 can be connected with an end of the rotary axle 136 for facilitating the assembly of the extension part 174, and is rotatable in unison with the rotary axle 136. For example, the end of the rotary axle 136 can be received in an opening 180A provided in the coupling portion 180 so as to rotationally couple the coupling portion 180 to the rotary axle 136. According to another example of construction, the coupling portion 180 may be formed integrally with the rotary axle 136.

According to an example of construction, the sliding part 172, the extension part 174 and the coupling portion 180 can be telescopically connected with one another. For example, the sliding part 172 can have a hollow interior 172H in which a portion of the extension part 174 having a matching shape is slidably disposed, and the extension part 174 can have a hollow interior 174H in which a portion of the coupling portion 180 having a matching shape is slidably disposed. With the construction described herein, the sliding part 172 and the extension part 174 can rotate in unison along with the coupling portion 180 and the rotary axle 136 about the rotation axis 144, and meanwhile slide along the rotation axis 144 relative to each other and the coupling portion 180 of the rotary axle 136. For example, the extension part 174 is slidable relative to the coupling portion 180 along the rotation axis 144 of the rotary axle 136 in the directions A1 and A2, and the sliding part 172 is slidable relative to the extension part 174 and the coupling portion 180 along the rotation axis 144 of the rotary axle 136 in the directions A1 and A2.

An engagement structure may be provided for allowing the extension part 174 to slide along with the sliding part 172 in the directions A1 and A2 for retraction and extension relative to the coupling portion 180. For example, this engagement structure may include two protrusions 172C and 172D provided on the sliding part 172 axially distant from each other, and a flange provided at one end of the extension part 174 that defines two opposite flange surfaces 174C and 174D. The sliding part 172 and the extension part 174 can slide in unison in the direction A2 relative to the coupling portion 180 with the protrusion 172C in contact with the flange surface 174C, and the protrusion 172C can be displaced away from the flange surface 174C when the sliding part 172 slides in the direction A1 relative to the extension part 174 and the coupling portion 180. Moreover, the sliding part 172 and the extension part 174 can slide in unison in the direction A1 relative to the coupling portion 180 with the protrusion 172D in contact with the flange surface 174D, and the protrusion 172D can be displaced away from the flange surface 174D when the sliding part 172 slides in the direction A2 relative to the extension part 174 and the coupling portion 180.

Figure 13:
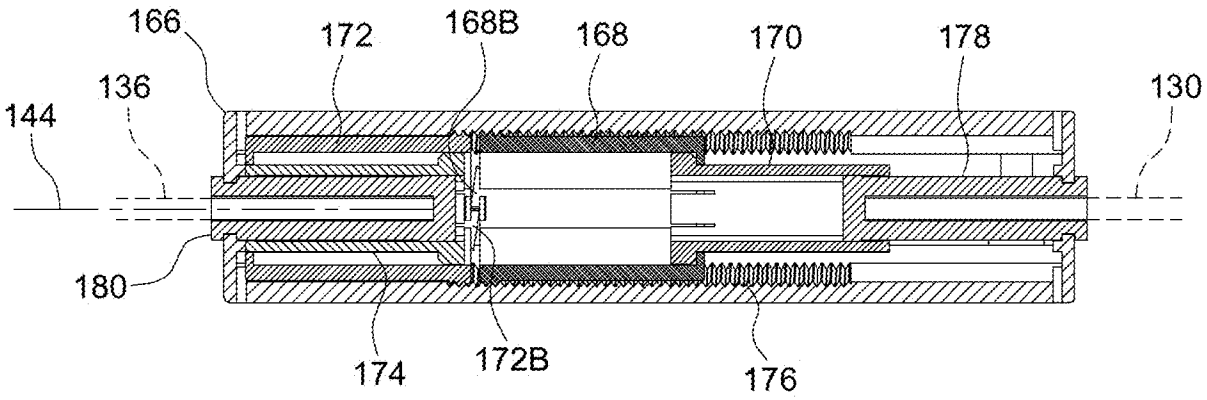
FIG. 13 is a cross-sectional view illustrating the limiting mechanism in a state where the intermediate rail and the bottom part of the window shade are fully raised.

In conjunction with FIGS. 1-12, FIGS. 13-15 are cross-sectional views illustrating exemplary operation of the limiting mechanism 142. Referring to FIG. 13, the limiting mechanism 142 is shown in a state where the bottom part 104 and the intermediate rail 106 are fully raised as shown in FIG. 3. The sliding part 172 can be adjacent to (with or without contacting) the stop structure 177B (better shown in FIG. 10) of the mount support 166, the extension part 174 can be substantially retracted inside the sliding part 172, and the coupling portion 180 of the rotary axle 136 can be substantially received inside the extending part 174. Moreover, the sliding part 168 can be in contact with the sliding part 172, and the extension part 170 can be extended relative to the sliding part 168 and the coupling portion 178 of the rotary axle 130.

Figure 14:
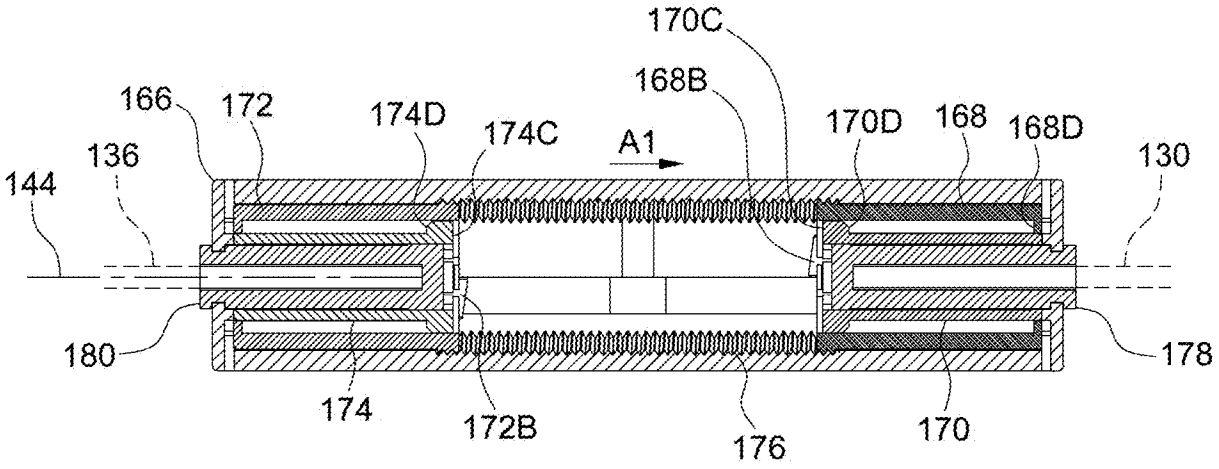
FIG. 14 is a cross-sectional view illustrating the limiting mechanism in a state where the bottom part is lowered to a lowest position with the intermediate rail remaining fully raised.

Referring to FIGS. 1, 8, 9 and 14, while the intermediate rail 106 remains stationary, the operating member 146 of the control module 134 can be operated to lower the bottom part 104 for expanding the shading structure 108. As a result, the rotary axle 130 rotates in a direction that causes the sliding part 168 to concurrently rotate about the rotation axis 144 and slide in the direction A1 away from the sliding part 172. This movement of the sliding part 168 can result in the extension part 170 being rotated about the rotation axis 144 and gradually received inside the sliding part 168. As the sliding part 168 slides in the direction A1, the protrusion 168C of the sliding part 168 may contact the flange surface 170C of the extension part 170 so that the sliding part 168 can urge the extension part 170 to slide in unison in the direction A1 relative to the coupling portion 178 of the rotary axle 130. Accordingly, the coupling portion 178 can be gradually received inside the extension part 170. Once the bottom part 104 reaches a desired position, the user can release the operating member 146 of the control module 134, and the sliding part 168 and the extension part 170 can accordingly stop moving. In case the bottom part 104 is lowered to a lowest position, the sliding part 168 can slide in the direction A1 until the protrusion 168A of the sliding part 168 engages the stop structure 177A for stopping the sliding part 168. When the bottom part 104 is in the lowest position, the sliding part 168 and the extension part 170 can be positioned as shown in FIG. 14, wherein the coupling portion 178 of the rotary axle 130 can be substantially received inside the extension part 170 and the extension part 170 can be substantially received inside the sliding part 168.

Figure 15:
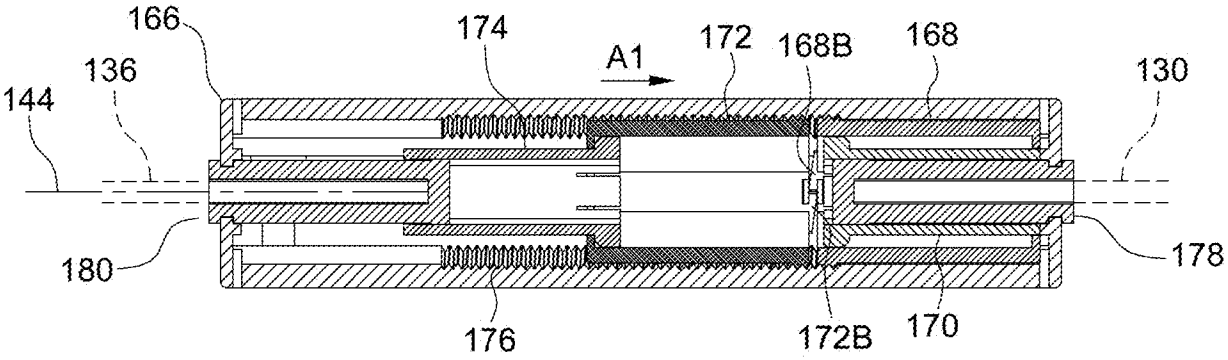
FIG. 15 is a cross-sectional view illustrating the limiting mechanism in a state where the bottom part and the intermediate rail are fully lowered.

Referring to FIGS. 2, 8, 9 and 15, while the bottom part 104 remains in a lowered position relative to the head rail 102, the operating member 164 of the control module 140 can be operated for lowering the intermediate rail 106. As a result, the rotary axle 136 rotates in a direction that causes the sliding part 172 to concurrently rotate about the rotation axis 144 and slide in the direction A1 toward the sliding part 168. This movement of the sliding part 172 can result in the extension part 174 being rotated about the rotation axis 144 and extended outside the sliding part 172. As the sliding part 172 slides in the direction A1, the protrusion 172D of the sliding part 172 may contact the flange surface 174D of the extension part 174 so that the sliding part 172 can urge the extension part 174 to slide in unison in the direction A1 relative to the coupling portion 180 of the rotary axle 136. Accordingly, the coupling portion 180 gradually extends outside the extension part 174. Once the intermediate rail 106 reaches a desired position, the user can release the operating member 164 of the control module 140, and the sliding part 172 and the extension part 174 can accordingly stop moving. In case the intermediate rail 106 is lowered to a lowest position adjacent to the bottom part 104, the sliding part 172 can slide in the direction A1 until the protrusion 172B of the sliding part 172 engages the protrusion 168B of the sliding part 168 for stopping the sliding part 172. Assuming that the bottom part 104 is in its lowest position relative to the head rail 102 and the intermediate rail 106 is lowered to its lowest position adjacent to the bottom part 104, the sliding part 168, the extension part 170, the sliding part 172 and the extension part 174 can be positioned as shown in FIG. 15. In this configuration, the coupling portion 180 of the rotary axle 136 can be substantially extended outside the extension part 174 and the extension part 174 can be substantially extended outside the sliding part 172, which is in contact with the sliding part 168.

In case the bottom part 104 is to be raised for collapsing the shading structure 108, the operating member 146 of the control module 134 can be operated to cause the rotary axle 130 to rotate in a direction that displaces the sliding part 168 in the direction A2 toward the sliding part 172. The sliding part 168 may concurrently rotate about the rotation axis 144 and slide in the direction A2 until the protrusion 168B of the sliding part 168 engages the protrusion 172B of the sliding part 172. Owing to the locking action exerted by the control module 140 on the rotary axle 136, the sliding part 172 can be held in position and consequently prevent the sliding part 168 from further sliding in the direction A2. Further upward displacement of the bottom part 104 can thus be prevented. Accordingly, the limiting mechanism 142 can prevent undesirable upward displacement of the intermediate rail 106 caused by a rise of the bottom part 104.

When the bottom part 104 is to be fully raised, a user first has to raise the intermediate rail 106 until it is positioned adjacent to the head rail 102, which displaces the sliding part 172 in the direction A2. Then the operating member 146 of the control module 134 can be operated for raising the bottom part 104. Accordingly, the sliding part 168 can slide in the direction A2 until the sliding part 168 contacts the sliding part 172, which can stop the bottom part 104 in the fully raised position.

Figure 16:
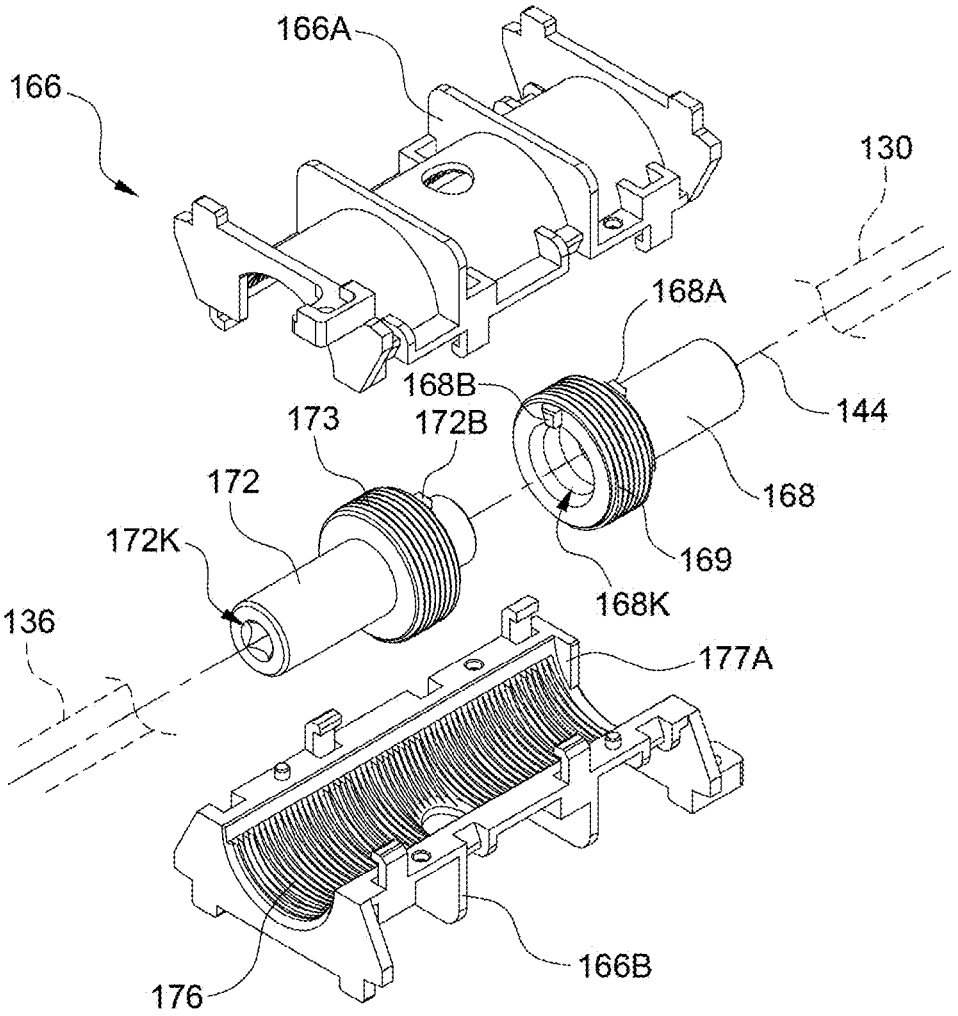
FIG. 16 is an exploded view illustrating a variant construction of the limiting mechanism.
Figure 17:
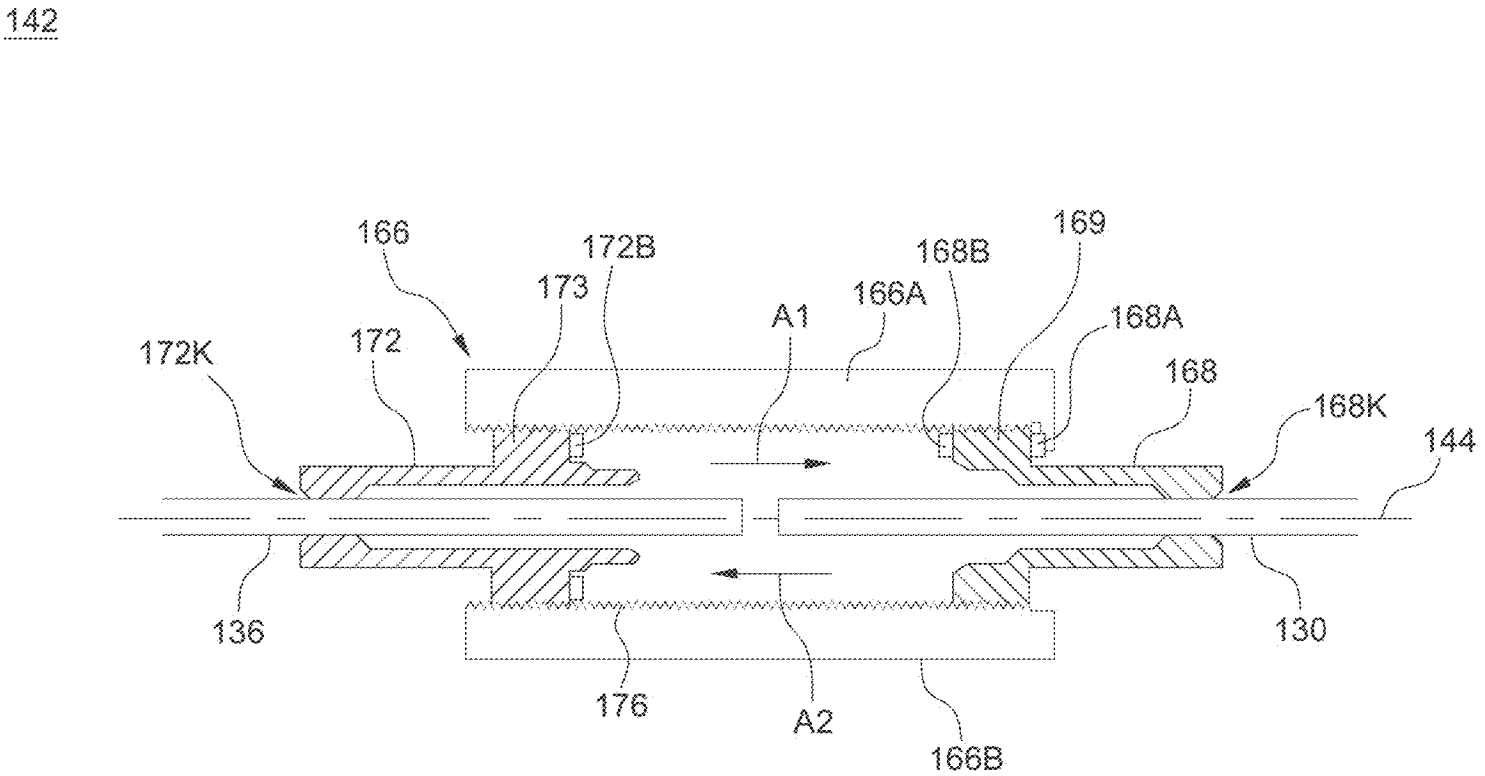
FIG. 17 is a cross-sectional view of the limiting mechanism shown in FIG. 16.

In conjunction with FIGS. 1-3, FIGS. 16 and 17 are respectively an exploded view and a partial cross-sectional view illustrating a variant construction of the limiting mechanism 142 that may be applied in the actuating system 110 of the window shade 100. Referring to FIGS. 16 and 17, the limiting mechanism 142 can likewise include the two sliding parts 168 and 172, but does not have the extension parts 170 and 174 of the previous embodiment. Like previously described, the sliding part 168 has a threaded portion 169 engaged with the threaded portion 176 of the mount support 166 and is movably linked to the rotary axle 130 so that a rotation of the rotary axle 130 causes the sliding part 168 to slide along the rotation axis 144 relative to the mount support 166. The sliding part 172 has a threaded portion 173 engaged with the threaded portion 176 of the mount support 166 and is movably linked to the rotary axle 136 so that a rotation of the rotary axle 136 causes the sliding part 172 to slide along the rotation axis 144 relative to the mount support 166.

In the embodiment of FIGS. 16 and 17, the sliding parts 168 and 172 can be respectively mounted directly on the rotary axles 130 and 136. For example, the sliding part 168 can have a hollow interior 168K in which a portion of the rotary axle 130 having a matching shape is slidably disposed, whereby the sliding part 168 can rotate along with the rotary axle 130 about the rotation axis 144 and meanwhile slide along the rotation axis 144 relative to the rotary axle 130. Likewise, the sliding part 172 can have a hollow interior 172K in which a portion of the rotary axle 136 having a matching shape is slidably disposed, whereby the sliding part 172 can rotate along with the rotary axle 136 about the rotation axis 144 and meanwhile slide along the rotation axis 144 relative to the rotary axle 136.

Figure 18:
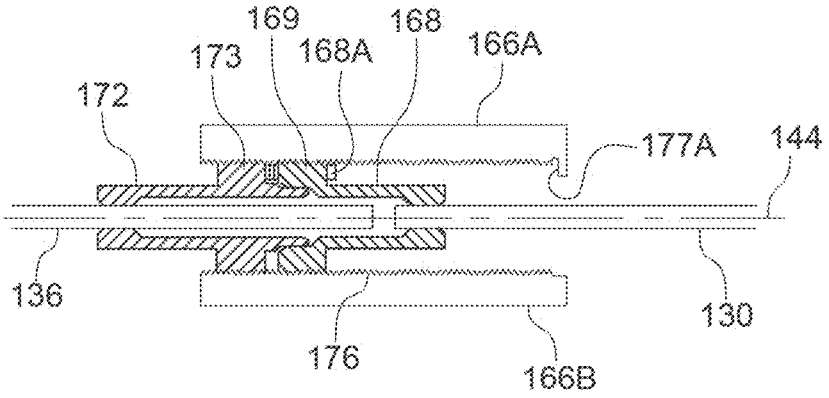
FIG. 18 is a cross-sectional view illustrating the limiting mechanism of FIGS. 16 and 17 in a state where the intermediate rail and the bottom part of the window shade are fully raised.

In conjunction with FIGS. 1-3, FIGS. 18-20 are cross-sectional views illustrating exemplary operation of the limiting mechanism 142 shown in FIGS. 16 and 17. Referring to FIGS. 16-20, the sliding parts 168 and 172 of the limiting mechanism 142 can operate similar to the previous embodiment. In FIG. 18, the limiting mechanism 142 is shown in a state where the bottom rail 104 and the intermediate rail 106 are fully raised such as shown in FIG. 3, wherein the protrusion 168B of the sliding part 168 can be in contact with the protrusion 172B of the sliding part 172.

Figure 19:
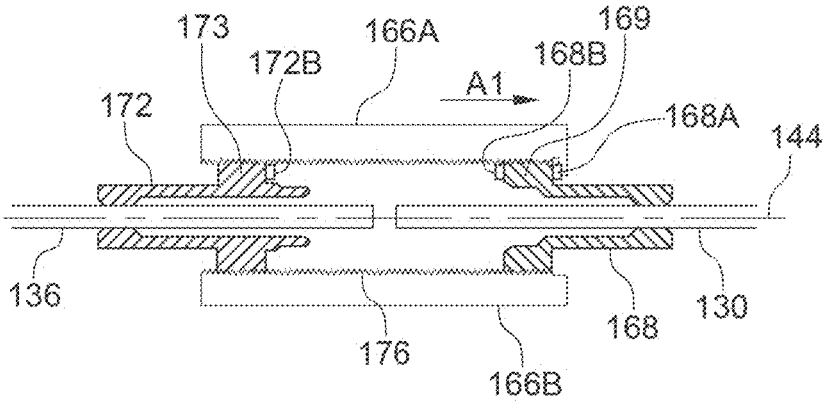
FIG. 19 is a cross-sectional view illustrating the limiting mechanism of FIGS. 16 and 17 in a state where the bottom part is lowered to a lowest position with the intermediate rail remaining fully raised.

Referring to FIGS. 1 and 19, while the intermediate rail 106 remains stationary, the operating member 146 of the control module 134 can be operated to lower the bottom part 104 for expanding the shading structure 108. As a result, the rotary axle 130 rotates in a direction that causes the sliding part 168 to concurrently rotate about the rotation axis 144 and slide on the rotary axle 130 in the direction A1 away from the sliding part 172. Once the bottom part 104 reaches a desired position, the user can release the operating member 146 of the control module 134, and the sliding part 168 can accordingly stop moving. In case the bottom part 104 is lowered to a lowest position, the sliding part 168 can slide in the direction A1 until the protrusion 168A of the sliding part 168 engages the stop structure 177A for stopping the sliding part 168 as shown in FIG. 19.

Figure 20:
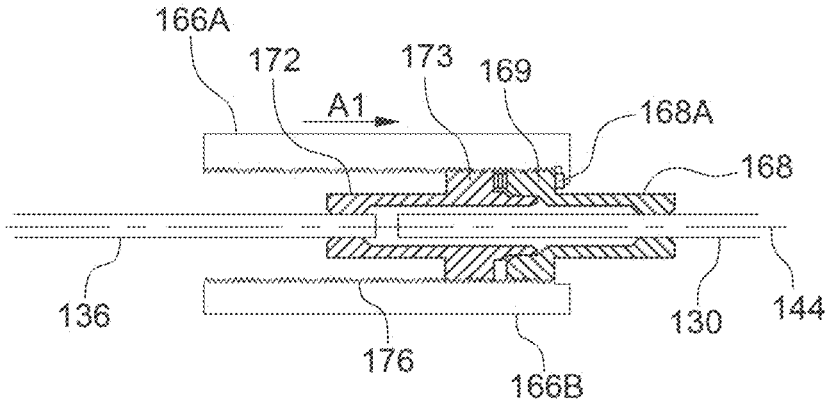
FIG. 20 is a cross-sectional view illustrating the limiting mechanism of FIGS. 16 and 17 in a state where the bottom part and the intermediate rail are fully lowered.

Referring to FIGS. 2 and 20, while the bottom part 104 remains in a lowered position relative to the head rail 102, the operating member 164 of the control module 140 can be operated for lowering the intermediate rail 106. As a result, the rotary axle 136 rotates in a direction that causes the sliding part 172 to concurrently rotate about the rotation axis 144 and slide on the rotary axle 136 in the direction A1 toward the sliding part 168. Once the intermediate rail 106 reaches a desired position, the user can release the operating member 164 of the control module 140, and the sliding part 172 can accordingly stop moving. In case the intermediate rail 106 is lowered to a lowest position adjacent to the bottom part 104, the sliding part 172 can slide in the direction A1 until the protrusion 172B of the sliding part 172 engages the protrusion 168B of the sliding part 168 for stopping the sliding part 172, as shown in FIG. 20. Like the previous embodiment, the limiting mechanism 142 shown in FIGS. 16-20 can prevent undesirable upward displacement of the intermediate rail 106 caused by a rise of the bottom part 104.

Figure 21:
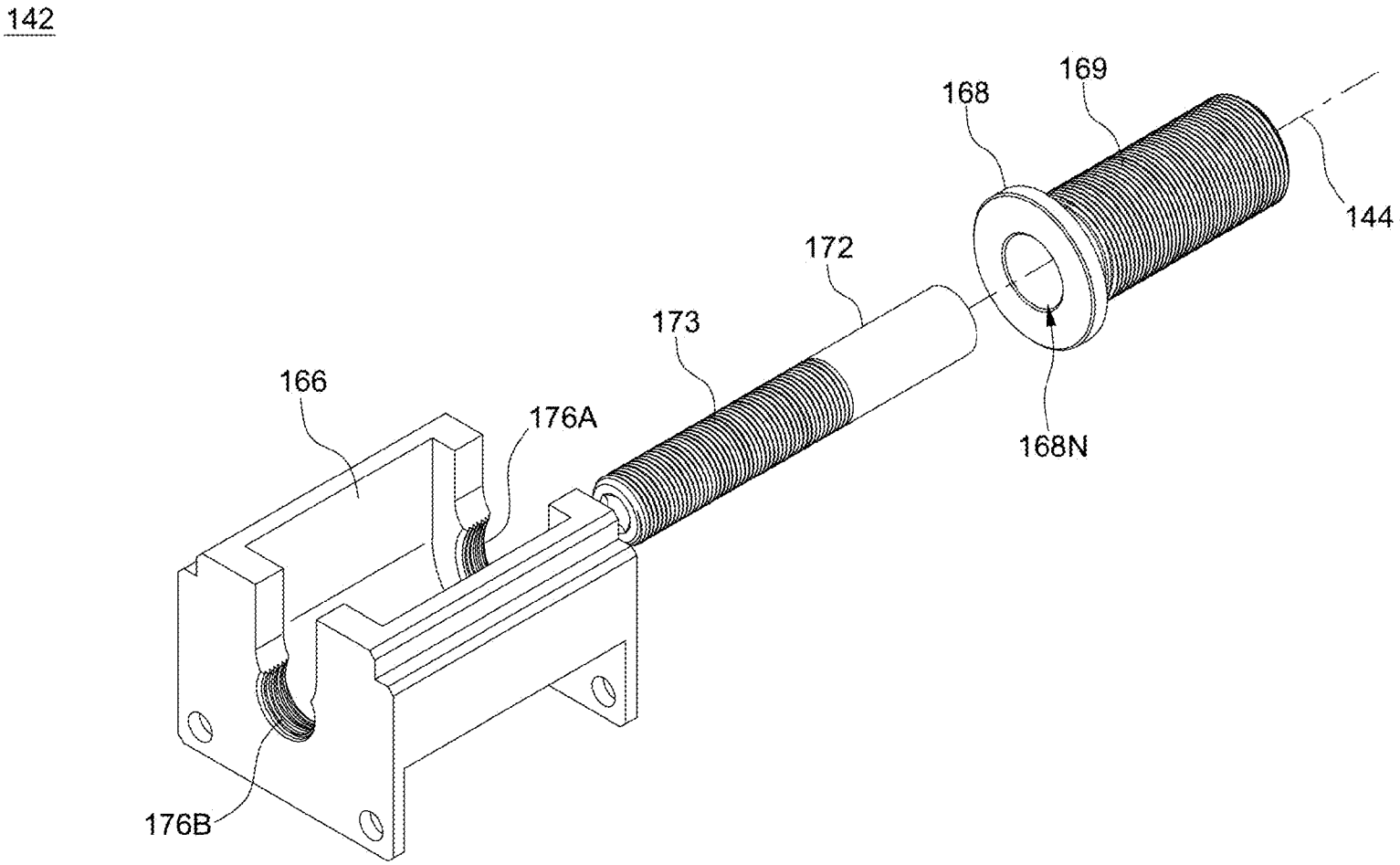
FIG. 21 is an exploded view illustrating another variant construction of the limiting mechanism.
Figure 22:
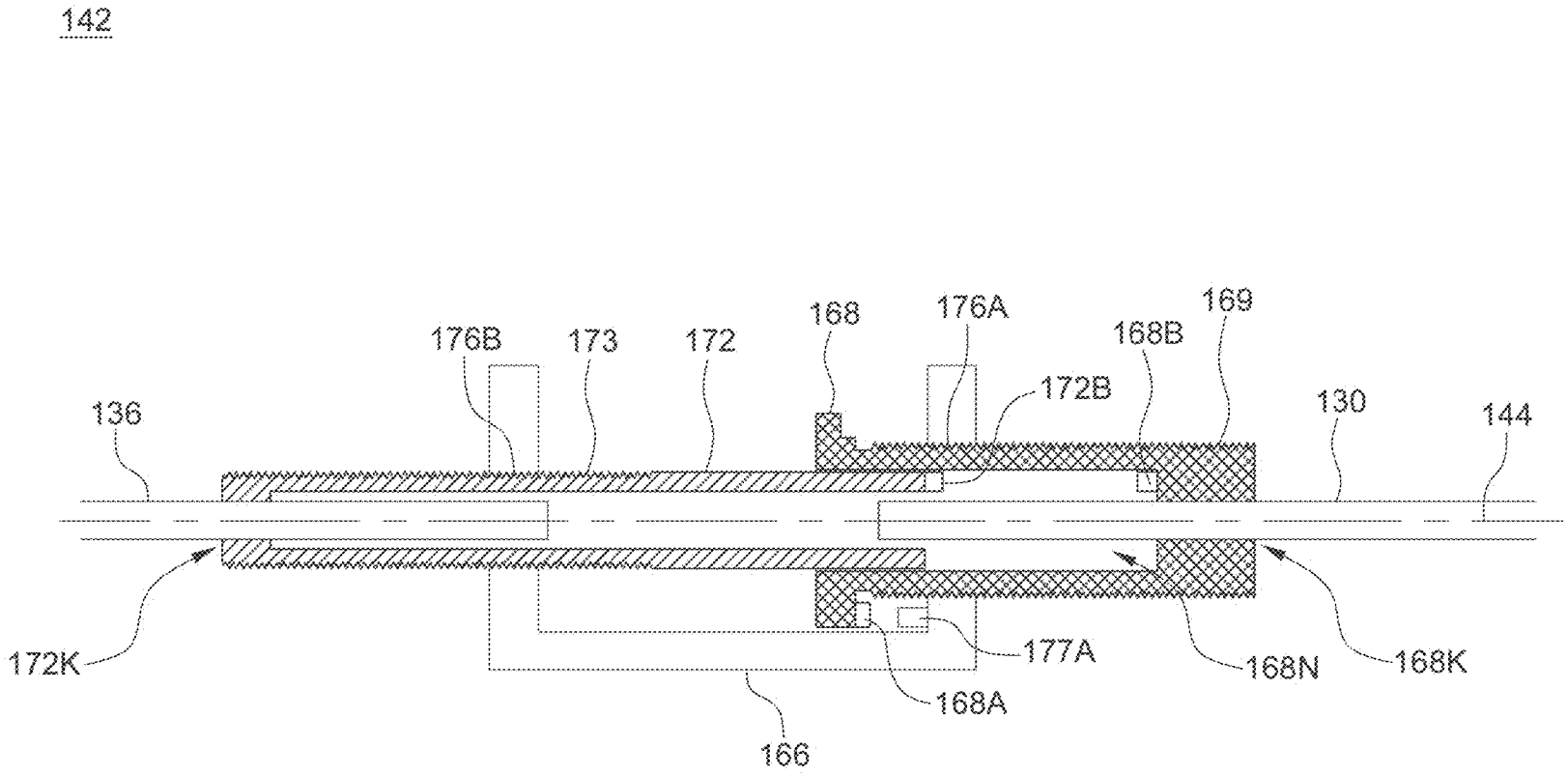
FIG. 22 is a cross-sectional view of the limiting mechanism shown in FIG. 21.

In conjunction with FIGS. 1-3, FIGS. 21 and 22 are respectively an exploded view and a cross-sectional view illustrating another variant construction of the limiting mechanism 142. Referring to FIGS. 21 and 22, the limiting mechanism 142 can likewise include the two sliding parts 168 and 172, but does not have the extension parts 170 and 174 of the embodiment shown in FIGS. 8 and 9. In the embodiment of FIGS. 21 and 22, the mount support 166 can be exemplarily a bracket, and can have two threaded portions 176A and 176B axially apart from each other. The threaded portions 176A and 176B can be exemplarily formed on circular or arcuate surfaces having an axis substantially coaxial to the rotation axis 144. According to an example of construction, the threaded portions 176A and 176B can be respectively provided in two opposite sidewalls of the mount support 166. The sliding part 168 has a threaded portion 169 engaged with the threaded portion 176A of the mount support 166 and is movably linked to the rotary axle 130 so that a rotation of the rotary axle 130 causes the sliding part 168 to slide along the rotation axis 144 relative to the mount support 166. The sliding part 172 has a threaded portion 173 engaged with the threaded portion 176B of the mount support 166 and is movably linked to the rotary axle 136 so that a rotation of the rotary axle 136 causes the sliding part 172 to slide along the rotation axis 144 relative to the mount support 166.

Referring to FIGS. 21 and 22, the sliding parts 168 and 172 can be respectively mounted directly on the rotary axles 130 and 136. For example, the sliding part 168 can have a hollow interior 168K in which a portion of the rotary axle 130 having a matching shape is slidably disposed, whereby the sliding part 168 can rotate along with the rotary axle 130 about the rotation axis 144 and meanwhile slide along the rotation axis 144 relative to the rotary axle 130. Likewise, the sliding part 172 can have a hollow interior 172K in which a portion of the rotary axle 136 having a matching shape is slidably disposed, whereby the sliding part 172 can rotate along with the rotary axle 136 about the rotation axis 144 and meanwhile slide along the rotation axis 144 relative to the rotary axle 136. For a compact assembly, the sliding part 168 can have a channel 168N adapted to receive at least partially the sliding part 172. The protrusion 168B can be provided at an end of the channel 168N, and the protrusion 172B can be provided at an end of the sliding part 172 that can be received in the channel 168N.

Figure 23:
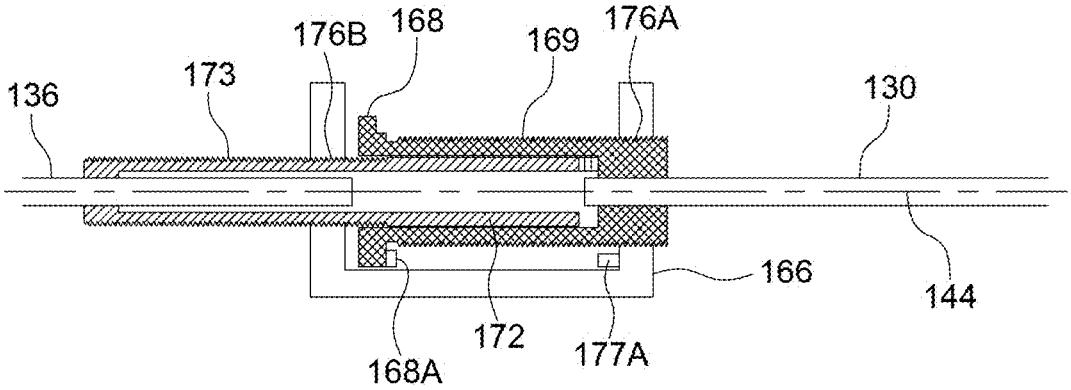
FIG. 23 is a cross-sectional view illustrating the limiting mechanism of FIGS. 21 and 22 in a state where the intermediate rail and the bottom part of the window shade are fully raised.

In conjunction with FIGS. 1-3, FIGS. 23-25 are cross-sectional views illustrating exemplary operation of the limiting mechanism 142 shown in FIGS. 21 and 22. In FIG. 23, the limiting mechanism 142 is shown in a state where the bottom rail 104 and the intermediate rail 106 are fully raised such as shown in FIG. 3, wherein the sliding part 172 is received at least partially inside the channel 168N of the sliding part 168 and the protrusion 168B of the sliding part 168 is in contact with the protrusion 172B of the sliding part 172 inside the channel 168B.

Figure 24:
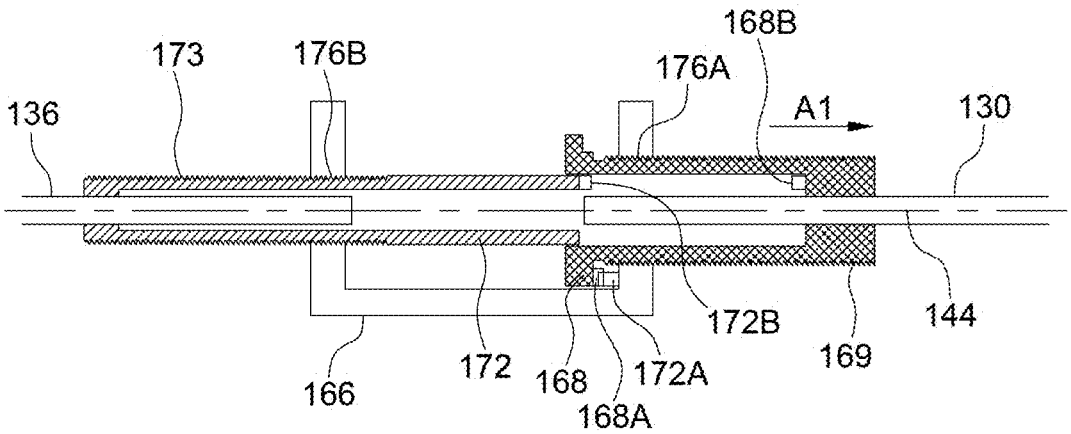
FIG. 24 is a cross-sectional view illustrating the limiting mechanism of FIGS. 21 and 22 in a state where the bottom part is lowered to a lowest position with the intermediate rail remaining fully raised.

Referring to FIGS. 1 and 24, while the intermediate rail 106 remains stationary, the operating member 146 of the control module 134 can be operated to lower the bottom part 104 for expanding the shading structure 108. As a result, the rotary axle 130 rotates in a direction that causes the sliding part 168 to concurrently rotate about the rotation axis 144 and slide on the rotary axle 130 in the direction A1. Once the bottom part 104 reaches a desired position, the user can release the operating member 146 of the control module 134, and the sliding part 168 can accordingly stop moving. In case the bottom part 104 is lowered to a lowest position, the sliding part 168 can slide in the direction A1 until the protrusion 168A of the sliding part 168 engages the stop structure 177A of the mount support 166 for stopping the sliding part 168 as shown in FIG. 24.

Figure 25:
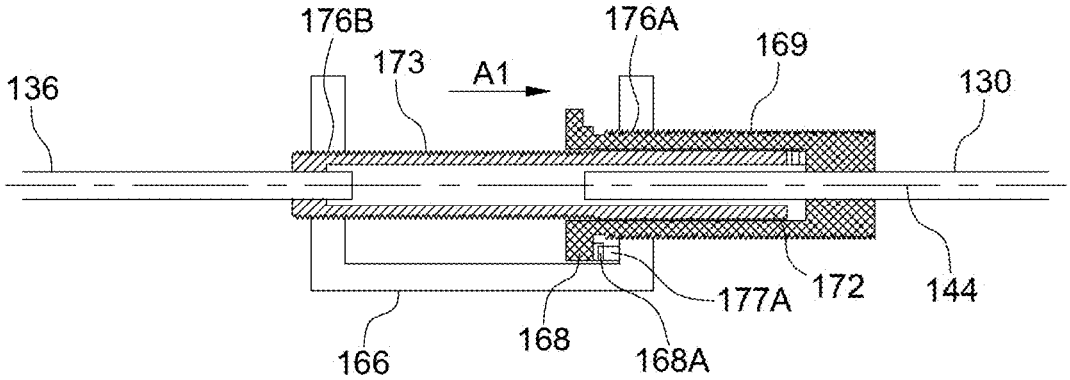
FIG. 25 is a cross-sectional view illustrating the limiting mechanism of FIGS. 21 and 22 in a state where the bottom part and the intermediate rail are fully lowered.

Referring to FIGS. 2 and 25, while the bottom part 104 remains in a lowered position relative to the head rail 102, the operating member 164 of the control module 140 can be operated for lowering the intermediate rail 106. As a result, the rotary axle 136 rotates in a direction that causes the sliding part 172 to concurrently rotate about the rotation axis 144 and slide on the rotary axle 136 in the direction A1. As the sliding part 172 slides in the direction A1, the sliding part 172 can travel inside the channel 168N of the sliding part 168. Once the intermediate rail 106 reaches a desired position, the user can release the operating member 164 of the control module 140, and the sliding part 172 can accordingly stop moving. In case the intermediate rail 106 is lowered to a lowest position adjacent to the bottom part 104, the sliding part 172 can slide in the direction A1 until the protrusion 172B of the sliding part 172 engages the protrusion 168B of the sliding part 168 for stopping the sliding part 172, as shown in FIG. 25. Like the previous embodiments, the limiting mechanism 142 shown in FIGS. 21-25 can prevent undesirable upward displacement of the intermediate rail 106 caused by a rise of the bottom part 104.

Advantages of the structures described herein include the ability to provide a window shade that has an actuating system operable to independently displace a bottom part and an intermediate rail for setting the window shade to a desired configuration. Moreover, the actuating system can have a limiting mechanism that can prevent undesirable upward displacement of the intermediate rail caused by a rise of the bottom part and undesirable downward displacement of the bottom part caused by a downward displacement of the intermediate rail. Therefore undesirable interaction between the bottom part and the intermediate rail can be prevented during operation, which may ensure reliable operation of the control modules respectively coupled to the bottom part and the intermediate rail.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. An actuating system for a window shade, comprising:

a first rotary axle and a second rotary axle rotatable independent of each other, the first rotary axle being rotatable for displacing a bottom part of the window shade, and the second rotary axle being rotatable for displacing an intermediate rail of the window shade, wherein the first rotary axle has a first major longitudinal axis, and the second rotary axle has a second major longitudinal axis coaxial to the first major longitudinal axis; and a limiting mechanism including a mount support, and a first and a second sliding part respectively connected with the mount support, the first sliding part being movably linked to the first rotary axle, and the second sliding part being movably linked to the second rotary axle;

wherein the first sliding part slides on a sliding axis coaxial to the first major longitudinal axis in a first direction when the first rotary axle rotates for lowering the bottom part and in a second direction opposite to the first direction when the first rotary axle rotates for raising the bottom part, the second sliding part slides on the sliding axis coaxial to the first major longitudinal axis in the first direction when the second rotary axle rotates for lowering the intermediate rail and in the second direction when the second rotary axle rotates for raising the intermediate rail, and the first sliding part is prevented from sliding in the second direction via a contact between the first sliding part and the second sliding part.

2. The actuating system according to claim 1, wherein the first sliding part is rotationally coupled to the first rotary axle and includes a first threaded portion, the second sliding part is rotationally coupled to the second rotary axle and includes a second threaded portion, and the mount support includes a third threaded portion respectively engaged with the first threaded portion and the second threaded portion.

3. The actuating system according to claim 2, wherein the first rotary axle has a coupling portion, and the first sliding part is rotationally coupled to the first rotary axle via a first extension part, the first sliding part and the first extension part being rotatable in unison along with the first rotary axle and the coupling portion, and the first extension part being respectively connected slidably with the first sliding part and the coupling portion of the first rotary axle so that the first extension part is slidable relative to the coupling portion along a rotation axis of the first rotary axle and the first sliding part is slidable relative to the first extension part and the coupling portion along the rotation axis.

4. The actuating system according to claim 3, wherein the first sliding part, the first extension part and the coupling portion are telescopically connected with one another.

5. The actuating system according to claim 3, wherein the first sliding part has a hollow interior in which a portion of the first extension part is slidably disposed, and the first extension part has a hollow interior in which the coupling portion of the first rotary axle is slidably disposed.

6. The actuating system according to claim 3, wherein the first sliding part has a first and a second protrusion, and the first extension part has a first and a second flange surface, the first sliding part and the first extension part being slidable in unison in the first direction relative to the coupling portion with the first protrusion in contact with the first flange surface, and the first sliding part and the first extension part being slidable in unison in the second direction relative to the coupling portion with the second protrusion in contact with the second flange surface.

7. The actuating system according to claim 2, wherein the second rotary axle has a second coupling portion, and the second sliding part is rotationally coupled to the second rotary axle via a second extension part, the second sliding part and the second extension part being rotatable in unison along with the second rotary axle and the second coupling portion, and the second extension part being respectively connected slidably with the second sliding part and the second coupling portion of the second rotary axle so that the second extension part is slidable relative to the second coupling portion along a rotation axis of the second rotary axle and the second sliding part is slidable relative to the second extension part and the second coupling portion along the rotation axis.

8. The actuating system according to claim 7, wherein the second sliding part, the second extension part and the second coupling portion are telescopically connected with one another.

9. The actuating system according to claim 7, wherein the second sliding part has a hollow interior in which a portion of the second extension part is slidably disposed, and the second extension part has a hollow interior in which the second coupling portion of the second rotary axle is slidably disposed.

10. The actuating system according to claim 7, wherein the second sliding part has a third and a fourth protrusion, and the second extension part has a third and a fourth flange surface, the second sliding part and the second extension part being slidable in unison in the second direction relative to the second coupling portion with the third protrusion in contact with the third flange surface, and the second sliding part and the second extension part being slidable in unison in the first direction relative to the second coupling portion with the fourth protrusion in contact with the fourth flange surface.

11. The actuating system according to claim 1, wherein the first sliding part has a course that is delimited by the second sliding part and a stop structure provided in the mount support.

12. The actuating system according to claim 1, wherein the first sliding part is rotationally coupled to the first rotary axle and includes a first threaded portion, the second sliding part is rotationally coupled to the second rotary axle and includes a second threaded portion, and the mount support includes a third and a fourth threaded portion apart from each other that are respectively engaged with the first threaded portion and the second threaded portion.

13. The actuating system according to claim 1, wherein the first sliding part has a channel, the first sliding part being able to contact the second sliding part inside the channel.

14. The actuating system according to claim 1, further including a first control module coupled to the first rotary axle, and a second control module coupled to the second rotary axle, the first control module being operable to drive the first rotary axle in rotation, and the second control module being operable to drive the second rotary axle in rotation.

15. The actuating system according to claim 14, wherein the first control module includes a first bead chain, and the second control module includes a second bead chain.

16. The actuating system according to claim 1, further including a first cord winding unit coupled to the first rotary axle, and a second cord winding unit coupled to the second rotary axle.

17. A window shade comprising:

a head rail, a bottom part, and an intermediate rail between the head rail and the bottom part;

a shading structure having a first and a second end respectively disposed adjacent to the intermediate rail and the bottom part; and the actuating system according to claim 16, the actuating system being assembled with the head rail, the first cord winding unit being connected with the bottom part via a first suspension cord, and the second cord winding unit being connected with the intermediate rail via a second suspension cord.

18. An actuating system for a window shade, comprising:

a first rotary axle and a second rotary axle rotatable independent of each other, the first rotary axle being rotatable for displacing a bottom part of the window shade, and the second rotary axle being rotatable for displacing an intermediate rail of the window shade; and a limiting mechanism including a mount support, and a first and a second sliding part respectively connected with the mount support, the first sliding part being movably linked to the first rotary axle, and the second sliding part being movably linked to the second rotary axle, wherein the first rotary axle has a coupling portion, and the first sliding part is rotationally coupled to the first rotary axle via a first extension part, the first sliding part and the first extension part being rotatable in unison along with the first rotary axle and the coupling portion, and the first extension part being respectively connected slidably with the first sliding part and the coupling portion of the first rotary axle so that the first extension part is slidable relative to the coupling portion along a rotation axis of the first rotary axle and the first sliding part is slidable relative to the first extension part and the coupling portion along the rotation axis;

wherein the first sliding part slides in a first direction when the first rotary axle rotates for lowering the bottom part and in a second direction opposite to the first direction when the first rotary axle rotates for raising the bottom part, the second sliding part slides in the first direction when the second rotary axle rotates for lowering the intermediate rail and in the second direction when the second rotary axle rotates for raising the intermediate rail, and the first sliding part is prevented from sliding in the second direction via a contact between the first sliding part and the second sliding part.

19. The actuating system according to claim 18, wherein the first sliding part has a first and a second protrusion, and the first extension part has a first and a second flange surface, the first sliding part and the first extension part being slidable in unison in the first direction relative to the coupling portion with the first protrusion in contact with the first flange surface, and the first sliding part and the first extension part being slidable in unison in the second direction relative to the coupling portion with the second protrusion in contact with the second flange surface.

* * * * *